US011897688B2

(12) United States Patent
Laan et al.

(10) Patent No.: US 11,897,688 B2
(45) Date of Patent: Feb. 13, 2024

(54) COLLAPSIBLE CARGO CONTAINER ASSEMBLY

(71) Applicant: Safran Cabin Cargo B.V., Alkmaar (NL)

(72) Inventors: Johannes Laan, Wervershoof (NL); Cornelis Portegies, Sijberkarspel (NL)

(73) Assignee: Safran Cabin Cargo B.V., Alkmaar (NL)

( * ) Notice: Subject to any disclaimer, the term of this patent is extended or adjusted under 35 U.S.C. 154(b) by 0 days.

(21) Appl. No.: 17/638,745

(22) PCT Filed: Aug. 28, 2020

(86) PCT No.: PCT/IB2020/058071
§ 371 (c)(1),
(2) Date: Feb. 25, 2022

(87) PCT Pub. No.: WO2021/038525
PCT Pub. Date: Mar. 4, 2021

(65) Prior Publication Data

US 2022/0219886 A1 Jul. 14, 2022

Related U.S. Application Data

(60) Provisional application No. 62/893,550, filed on Aug. 29, 2019.

(51) Int. Cl.
*B65D 88/14* (2006.01)
*B65D 88/52* (2006.01)
*B65D 88/12* (2006.01)

(52) U.S. Cl.
CPC ..... *B65D 88/524* (2013.01); *B65D 88/12* (2013.01)

(58) Field of Classification Search
CPC ..... B65D 88/12; B65D 88/52; B65D 88/524; B65D 88/522; B65D 90/021; B65D 90/008
(Continued)

(56) References Cited

U.S. PATENT DOCUMENTS 4,802,600 A * 2/1989 Bretschneider ..... B65D 88/14 220/668
5,890,612 A * 4/1999 Coppi ..... B65D 88/524 220/531
(Continued)

FOREIGN PATENT DOCUMENTS

DE 69702821 T2 4/2001
EP 3305688 A1 4/2018
(Continued)

OTHER PUBLICATIONS

International Search Report and Written Opinion—International Application No. PCT/IB2020/058071 dated Aug. 28, 2020 (dated Aug. 28, 2020).

*Primary Examiner* — John K Fristoe, Jr.
*Assistant Examiner* — Elizabeth J Volz
(74) *Attorney, Agent, or Firm* — Kilpatrick Townsend & Stockton LLP

(57) ABSTRACT

A collapsible container assembly that includes a first lateral side wall having a door frame and a first shear wall, a second lateral side wall that opposes the first lateral side wall and includes a wall panel and a second shear wall, an outboard wall that includes upper and lower panels that are pivotably connected to one another, an inboard wall that opposes the outboard wall and includes upper and lower panels that are pivotably connected to one another, a base and a top. The first shear wall is pivotable between a use position where the first shear wall is not positioned in the door frame interior and a stowed position where the first shear wall is positioned in the door frame interior. The second shear wall is pivotable between a use position where the second shear wall is not positioned in the wall panel interior and a stowed position where the second shear wall is positioned in the wall panel interior. The door frame, wall panel, inboard wall and outboard wall are pivotably connected to the base, and the inboard wall and outboard wall are pivotably connected to the top.

14 Claims, 20 Drawing Sheets

(58) Field of Classification Search
USPC ..... 220/6, 9.1, 9.2, 810, 4.28, 668
See application file for complete search history.

(56) References Cited

U.S. PATENT DOCUMENTS

| | | | | | |
|---|---|---|---|---|---|
| 5,941,405 | A * | 8/1999 | Scales | B65D 88/522 | 220/4.28 |
| 6,299,009 | B1 * | 10/2001 | Ryziuk | B65D 90/021 | 220/6 |
| 8,261,924 | B2 * | 9/2012 | Karpisek | B65D 88/522 | 220/4.28 |
| 8,800,797 | B2 * | 8/2014 | Fingerhut | B65D 88/14 | 220/88.1 |
| 8,973,769 | B2 * | 3/2015 | Huber | B65D 90/08 | 220/691 |
| 9,150,348 | B2 * | 10/2015 | Naber | B65D 88/14 | |
| 9,511,930 | B2 * | 12/2016 | Daoud | B65D 90/022 | |
| 2007/0056977 | A1 * | 3/2007 | Dobrinski | B65D 11/1826 | 220/600 |

FOREIGN PATENT DOCUMENTS

| | | | | |
|---|---|---|---|---|
| NL | 1007468 | C2 | 5/1999 | |
| WO | 2009/036484 | A1 | 3/2009 | |
| WO | WO2009036484 | * | 3/2009 | B65D 88/14 |

* cited by examiner

COLLAPSIBLE CARGO CONTAINER ASSEMBLY

CROSS REFERENCE TO RELATED APPLICATIONS

This application is a national stage application, filed under 35 U.S.C. § 371, of International Patent Application No. PCT/IB2020/058071, filed on Aug. 28, 2020, which claims the benefit of U.S. Provisional Application No. 62/893,550, filed Aug. 29, 2019, the entireties of which are incorporated herein by reference.

FIELD OF THE INVENTION

The present invention relates generally to a collapsible cargo container assembly.

BACKGROUND OF THE INVENTION

For a number of reasons collapsible containers have advantages over normal containers, for example, because of lower volume in storage or while shipping them to a different location while empty (by air or by road trucking). Collapsible containers (also called foldable containers or foldable collapsible unit load devices (ULD's) exist but there are several downsides to the use and operation of the existing products. Current designs are often heavy, not watertight, hard to fold/unfold and fragile during operation. Stacking and storing can be time consuming and because of the folded footprint the actual space saving is often not advantageous. These downsides make them unpopular with airline operators and therefore, few operators use them.

In the present invention, the method of folding is different than prior devices. The present invention is user friendly, preferably water tight, more robust, lighter and the folded footprint is preferably less than the prior art. Although the smaller footprint is not a limitation on the present invention and the footprint can be the same as or more than the prior art. The design is also optimized for storing the folded units more efficiently.

The background description disclosed anywhere in this patent application includes information that may be useful in understanding the present invention. It is not an admission that any of the information provided herein is prior art or relevant to the presently claimed invention, or that any publication specifically or implicitly referenced is prior art.

SUMMARY OF THE PREFERRED EMBODIMENTS

In accordance with a first aspect of the present invention there is provided a collapsible container assembly that includes a first lateral side wall having a door frame and a first shear wall, a second lateral side wall that opposes the first lateral side wall and includes a wall panel and a second shear wall, an outboard wall that includes upper and lower panels that are pivotably connected to one another, an inboard wall that opposes the outboard wall and includes upper and lower panels that are pivotably connected to one another, a base and a top. The first shear wall is pivotable between a use position where the first shear wall is not positioned in the door frame interior and a stowed position where the first shear wall is positioned in the door frame interior. The second shear wall is pivotable between a use position where the second shear wall is not positioned in the wall panel interior and a stowed position where the second shear wall is positioned in the wall panel interior. The door frame, wall panel, inboard wall and outboard wall are pivotably connected to the base, and the inboard wall and outboard wall are pivotably connected to the top.

In a preferred embodiment, the first shear panel is pivotable 180° between the use position and the stowed position, and the second shear panel is pivotable 180° between the use position and the stowed position. Preferably, the door frame together with the first shear panel is pivotable between a vertical use position and a horizontal stowed position, and the wall panel together with the second shear panel is pivotable between a vertical use position and a horizontal stowed position. In a preferred embodiment, the outboard wall is pivotable between a use position and a stowed position where the upper panel is positioned above the lower panel. Preferably, the inboard wall is pivotable between a use position and a stowed position where the upper panel is positioned above the lower panel. Preferably, the when the collapsible container assembly is in the collapsed position, the top is positioned above the upper panels of the inboard and outboard walls.

In a preferred embodiment, the pivotable connection between the outboard wall and the base comprises a bottom hinge assembly that includes a hinge rod that defines a hinge rod axis. The outboard wall is pivotable between a use position, a stowed position and an assembly position. In the assembly position the outboard wall is slidable in a direction that is parallel with the hinge rod axis. Preferably, the bottom hinge assembly includes a hinge portion associated with one of the base and the outboard wall and a knuckle portion associated with the other of the base and the outboard wall. Preferably, the knuckle portion includes a plurality of spaced apart C-shaped knuckle members that each include a channel defined therein and the C-shaped knuckle members define a knuckle opening. Preferably, the hinge portion includes a first extension member that extends upwardly from the base or downwardly from the outboard wall, a second extension member extending outwardly from the first extension member and the hinge rod on a distal end of the first extension member. A plurality of knuckle receiving openings are defined in the first and second extension members. The hinge rod is received in the knuckle openings. When the outboard wall is in the assembly position the channels defined in the plurality of knuckle members are aligned with the second extension members, such that the second extension members can be received in and slid along the channels when the outboard wall is slid off, removed from or disassembled from the base.

In a preferred embodiment, the first shear panel is pivotably connected to the door frame at a position in the door frame interior. The pivotable connection between the first shear panel and the door frame includes a hinge member associated with one of the first shear panel and the door frame and a hinge pin associated with the other of the first shear panel and the door frame. A connection member extends outwardly from the hinge member and connects to the first shear panel (a frame member thereof). The door frame includes top, bottom, left and right frame members. A clearance recess is defined by the hinge member, the connection member and a (proximal or rotating) frame member of the first shear panel. In the use position, the left frame member of the door frame is received in the clearance recess and in the stowed position, the left frame member of the door frame is not received in the clearance recess.

In a preferred embodiment, the first shear panel includes a proximal frame member (the rotating frame member) and a distal frame member (that moves in an arc between the use and stowed positions). The distal frame member includes a vertically extending tab and an adjacent vertically extending recess. The upper panel of the outboard wall includes a plurality of frame members and at least one of the frame members includes a vertically extending tab and an adjacent vertically extending recess. When the first shear panel is in the use position, the vertically extending tab of the first shear panel is received in the vertically extending recess of the upper panel of the outboard wall and the vertically extending tab of the upper panel of the outboard wall is received in the vertically extending recess of the first shear panel to secure the first shear panel to the outboard wall. The vertically extending tabs may contact one another and be displaced via a rounded or inclined surface when the first shear panel is moved to the use position.

In a preferred embodiment, in the collapsed position a footprint of the collapsible container assembly is defined by a footprint of the top. In other words, the length and width of the top is the length and width of the entire container assembly when in the collapsed position.

In accordance with another aspect of the present invention there is provided a method of collapsing a container assembly from a use position to a collapsed position. The method includes obtaining the container assembly. The container assembly includes opposing first and second lateral walls, opposing inboard and outboard walls, a top and a bottom. The outboard wall includes an upper panel pivotably connected to a lower panel, the inboard wall includes an upper panel pivotably connected to a lower panel, the outboard wall is pivotably connected to the top and to the base, and the inboard wall is pivotably connected to the top and to the base. The method also includes pivoting a first shear wall of the first lateral side wall from a use position to a stowed position (this is preferably about a vertical axis). In the stowed position the first shear wall is received in a door frame interior of a door frame of the first lateral side wall. The method also includes pivoting a second shear wall of the second lateral side wall from a use position to a stowed position (this is preferably about a vertical axis). In the stowed position the second shear wall is received in a wall panel interior of a wall panel of the second lateral side wall. The method also includes pivoting the door frame together with the first shear wall downwardly from a use position to a stowed position (this is preferably about a horizontal axis), pivoting the wall panel together with the second shear wall downwardly from a use position to a stowed position (this is preferably about a horizontal axis), pivoting the outboard wall downwardly from a use position to a stowed position where the upper panel is positioned above the lower panel, and pivoting the inboard wall downwardly from a use position to a stowed position where the upper panel is positioned above the lower panel.

In a preferred embodiment, the pivotable connection between the inboard wall and the base includes a horizontally extending hinge rod that defines a hinge rod axis. The method may include pivoting the inboard wall to an assembly position and sliding the inboard wall in a direction parallel to the hinge rod axis.

In accordance with another aspect of the present invention there is provided a collapsible container assembly that includes first and second opposing lateral side walls, inboard and outboard opposing lateral side walls, and a top and a bottom. The first and second opposing lateral side walls, inboard and outboard opposing lateral side walls, top and bottom cooperate to define a container interior. The first lateral side wall (and/or the first shear panel, which is part of the first lateral wall) is pivotable with respect to the inboard wall. The first lateral side wall includes a first frame member and the inboard wall includes a second frame member. The first frame member includes a first vertically extending tab and an adjacent first vertically extending recess, wherein the second frame member includes a second vertically extending tab and an adjacent second vertically extending recess. The first vertically extending tab is received in the second vertically extending recess and the second vertically extending tab is received in the first vertically extending recess. In a preferred embodiment, the second frame member includes an extension portion, and the second tab is positioned on the extension portion. In a preferred embodiment, a liquid path is defined between the first frame member and the second frame member. The liquid path extends through a path entrance, a first U-shaped channel, a second U-shaped channel that faces in a direction opposite the first U-shaped channel, an extended portion defined between the first and second frame members and a path exit that communicates with the container interior. Preferably, the first and second U-shaped channels include a common arm. This liquid path provides liquid or water resistance. The liquid path is also preferably defined between the inboard wall and the second lateral wall (and/or the second shear panel), the outboard wall and the second lateral wall (and/or the second shear panel) and the outboard wall and the first lateral wall (and/or the first shear panel).

In accordance with another aspect of the present invention there is provided a collapsible container assembly that includes first and second opposing lateral side walls, inboard and outboard opposing lateral side walls, a top and a bottom, and a bottom hinge assembly that pivotably connects the inboard wall and the bottom. The first and second opposing lateral side walls, inboard and outboard opposing lateral side walls, top and bottom cooperate to define a container interior. The bottom hinge assembly includes a hinge rod that defines a hinge rod axis. The outboard wall is pivotable between a use position, a stowed position and an assembly position. In the assembly position the outboard wall is slidable in a direction that is parallel with the hinge rod axis.

The present invention is a foldable cargo container that is designed to provide a better return ratio than the prior art. The present invention also may improve on one or more of the following compared to the prior art: footprint, stackability, weight and water resistance.

In use, by folding the front and the back of the container inwardly onto the pallet, the remainder of the ULD can be folded downwardly. Therefore, in a preferred embodiment, the actual footprint of the container is the roof or top itself. This also creates a surface on which another foldable container can be stacked. The front and the back of the ULD are designed in a way that the shear panels self-cross into the forward and aft panels. Interlocking extrusions that grab into each other when extreme loads occur but also ensure stability of the container help provide water resistance and withstand certification loads. These features help minimize the folded footprint, but at the same time improve the water tightness, provide for a sturdy and easy to operate unit that is efficient when shipped folded. The integrated hinges used on at least a portion of the extrusions also provide better water tightness than conventional hinge constructions, while providing excellent stability and strength at a low weight.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
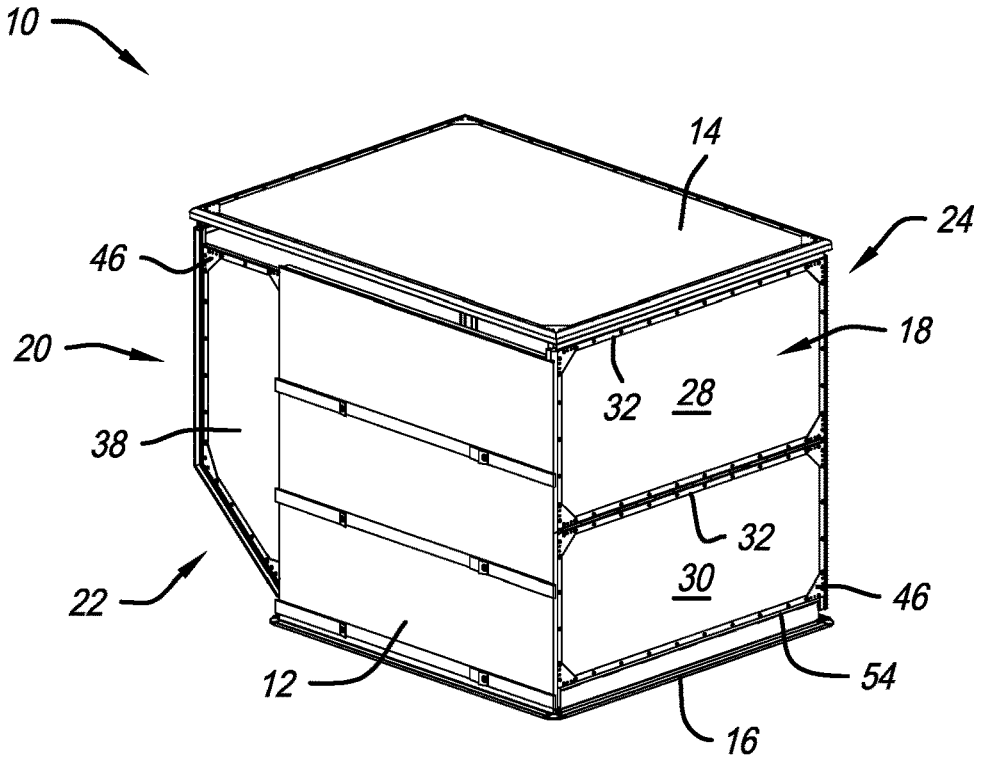
FIG. 1 is a perspective view of a collapsible cargo container assembly in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are references to the same embodiment; and, such references mean at least one of the embodiments. If a component is not shown in a drawing then this provides support for a negative limitation in the claims stating that that component is "not" present. However, the above statement is not limiting and in another embodiment, the missing component can be included in a claimed embodiment.

Reference in this specification to "one embodiment," "an embodiment," "a preferred embodiment" or any other phrase mentioning the word "embodiment" means that a particular feature, structure, or characteristic described in connection with the embodiment is included in at least one embodiment of the-disclosure and also means that any particular feature, structure, or characteristic described in connection with one embodiment can be included in any embodiment or can be omitted or excluded from any embodiment. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others and may be omitted from any embodiment. Furthermore, any particular feature, structure, or characteristic described herein may be optional. Similarly, various requirements are described which may be requirements for some embodiments but not other embodiments. Where appropriate any of the features discussed herein in relation to one aspect or embodiment of the invention may be applied to another aspect or embodiment of the invention. Similarly, where appropriate any of the features discussed herein in relation to one aspect or embodiment of the invention may be optional with respect to and/or omitted from that aspect or embodiment of the invention or any other aspect or embodiment of the invention discussed or disclosed herein.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted.

It will be appreciated that the same thing can be said in more than one way. Consequently, alternative language and synonyms may be used for any one or more of the terms discussed herein. No special significance is to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," "aft," "forward," "inboard," "outboard" and "below" used herein are merely for ease of description and refer to the orientation of the components as shown in the figures. It should be understood that any orientation of the components described herein is within the scope of the present invention.

Referring now to the drawings, which are for purposes of illustrating the present invention and not for purposes of limiting the same, the drawings show a collapsible cargo container assembly 10. As shown in FIGS. 1-10, the container assembly 10 generally includes a series of panels, some of which include hinges therebetween that allow the container assembly 10 to be folded and unfolded between a use position or configuration and a collapsed position or configuration.

Figure 2:
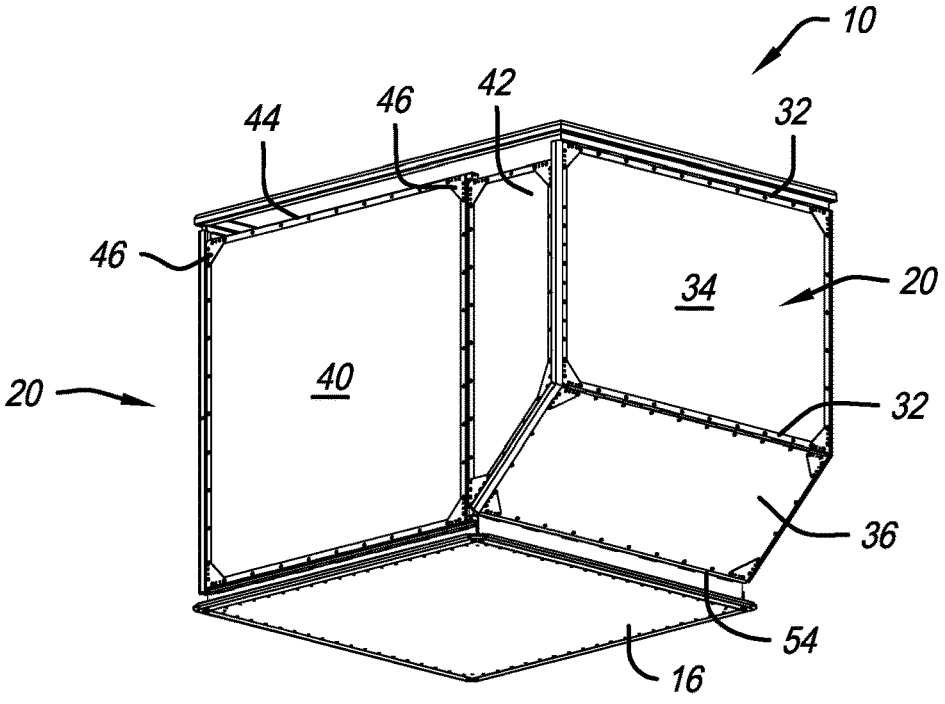
FIG. 2 is another perspective view of the container assembly of FIG. 1 from the other side.
Figure 3:
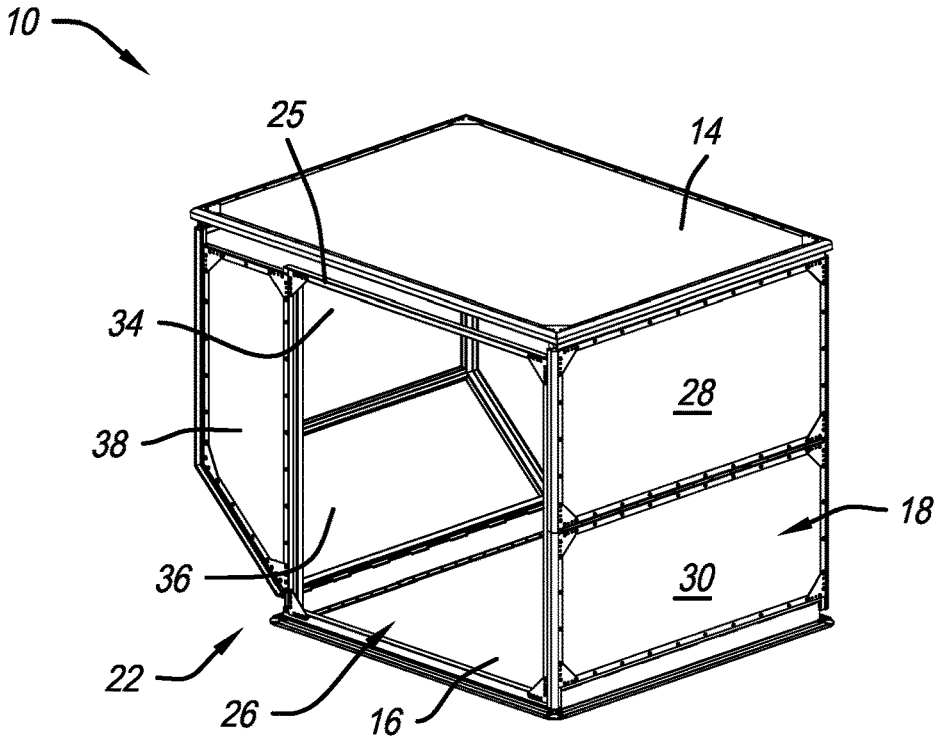
FIG. 3 is a perspective view of the container assembly with the door removed.

In a preferred embodiment, as shown in FIGS. 1-3, the container assembly 10 includes a door 12, a top 14, a base 16, an inboard side or wall 18, an outboard side or wall 20, a first lateral side or wall 22 and a second lateral side or wall 24. In a preferred embodiment, the door 12 is positioned on the first wall 22. However, the door 12 can be positioned on any of the other walls. The door 12 preferably is secured to a door frame 25 that defines a door opening 26.

The inboard wall 18 includes upper and lower panels 28 and 30 that are hingedly or pivotably secured to one another by one or more hinges 32 or other pivotable connection. The outboard wall 20 includes upper and lower panels 34 and 36 that are hingedly or pivotably secured to one another by one or more hinges 32 or other pivotable connection. In a preferred embodiment, the lower panel 36 of the outboard wall 20 angles inwardly (i.e., is not vertical) to provide efficiency for when it is positioned in the cargo hold of an aircraft. The first lateral side wall 22 includes the door 12 and a first shear panel 38. The second lateral side wall 24 includes a wall panel 40 and a second shear panel 42. The container assembly 10 also preferably includes a plurality of posts, frame members or extrusions (described more fully below), corner brackets 46 and similar hardware to secure the panels and walls together. All of the frame members of the various panels are referred to herein as a frame member 44.

Figure 4:
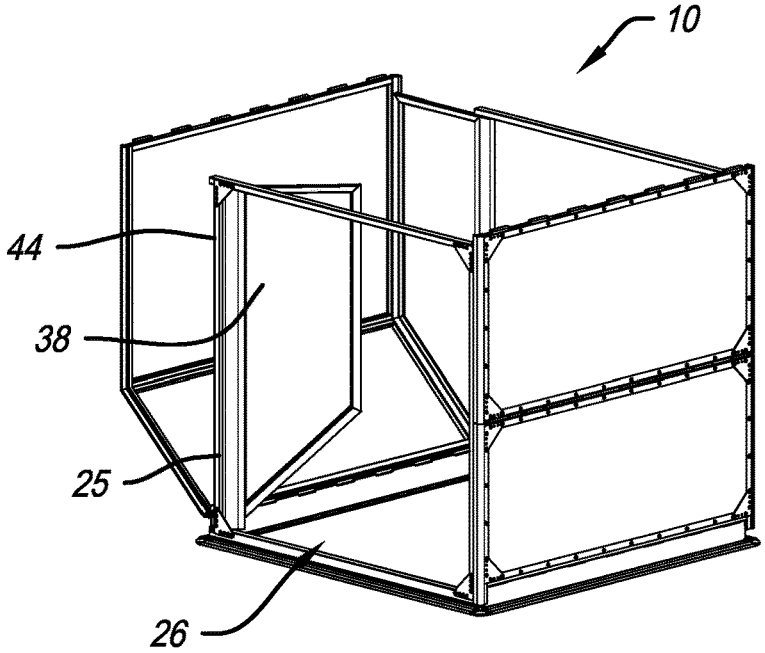
FIG. 4 is a perspective view of the container assembly with the first shear panel partially folded inwardly and the top removed.
Figure 5:
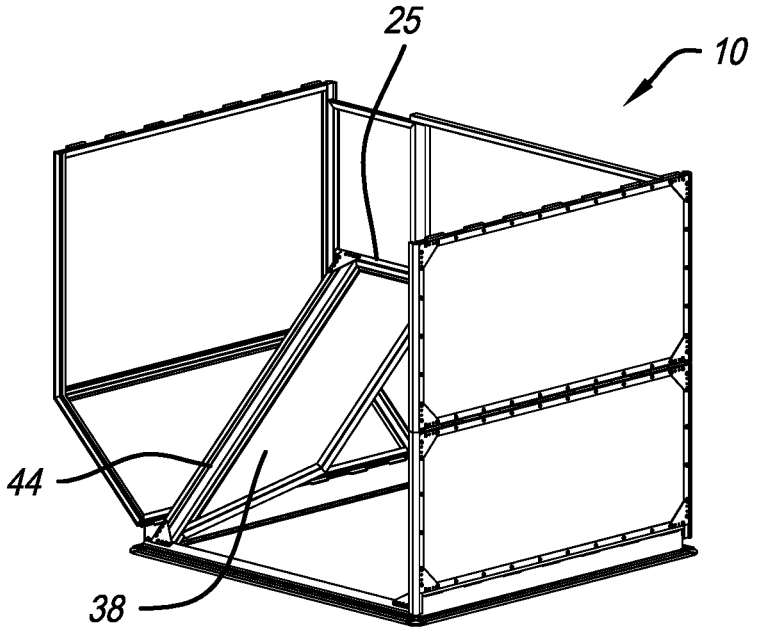
FIG. 5 is a perspective view of the container assembly with the first shear panel folded to the stowed position, the door frame partially folded downwardly and the top removed.
Figure 16:
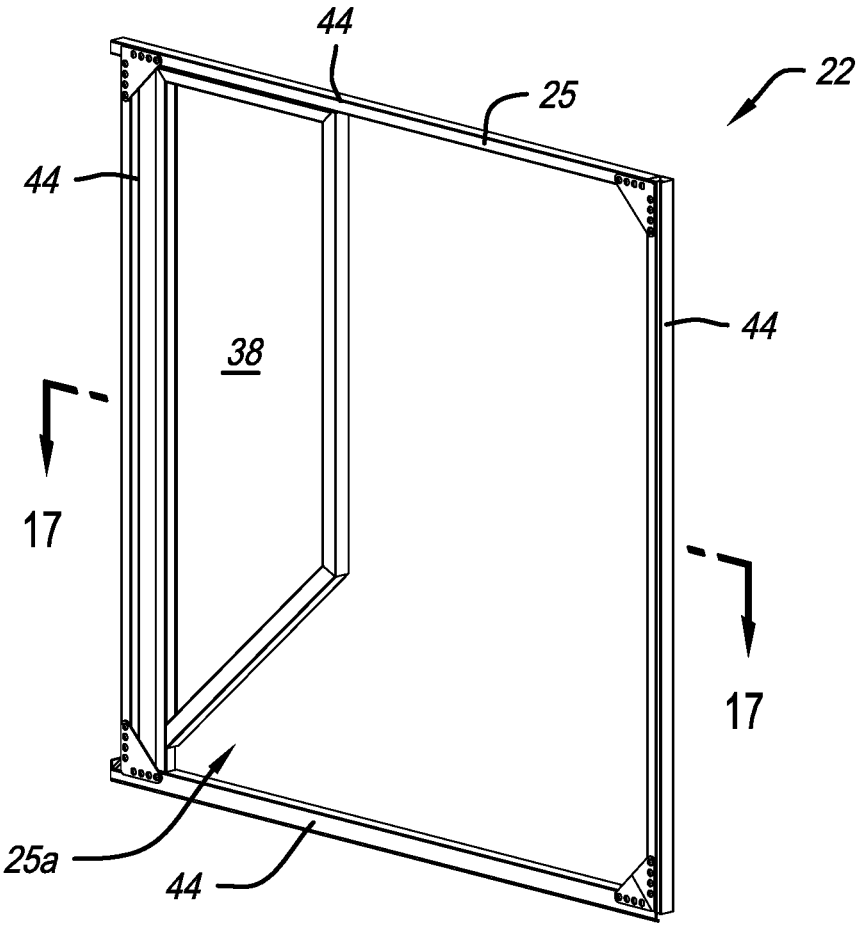
FIG. 16 is a perspective view of the first lateral wall with the first shear wall in the stowed position.

FIGS. 1-11 show the preferred steps for folding or collapsing the container assembly 10 from the use position and the collapsed position. FIG. 1 shows the container assembly 10 in the use position. As shown in FIG. 3, first, the door 12 is removed. As shown in FIG. 4, next, the first shear panel 38 is folded inwardly from the use position (FIG. 3) to the stowed position (FIGS. 5 and 16). FIG. 4 shows the first shear panel 38 partially folded inwardly. In the stowed position, the first shear panel 38 is received in the door frame 25.

Figure 6:
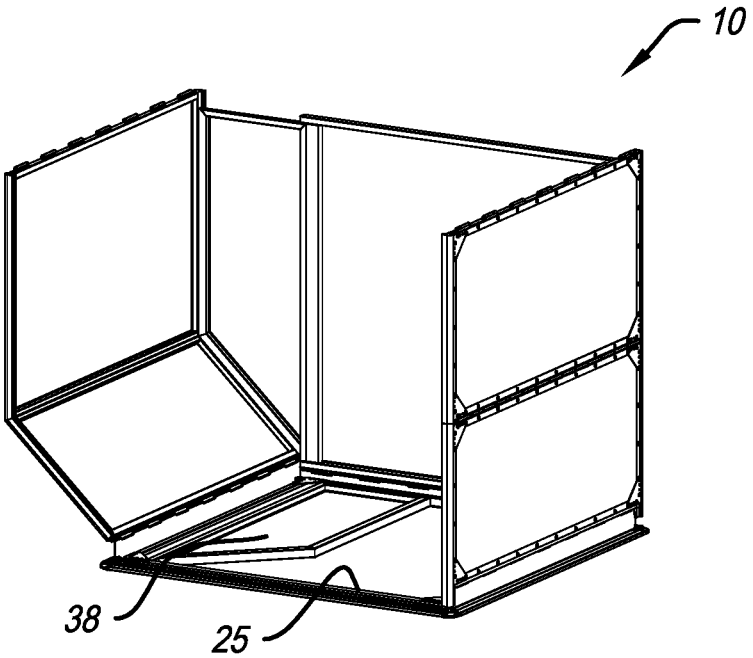
FIG. 6 is a perspective view of the container assembly with the door frame folded downwardly to the stowed position.
Figure 7:
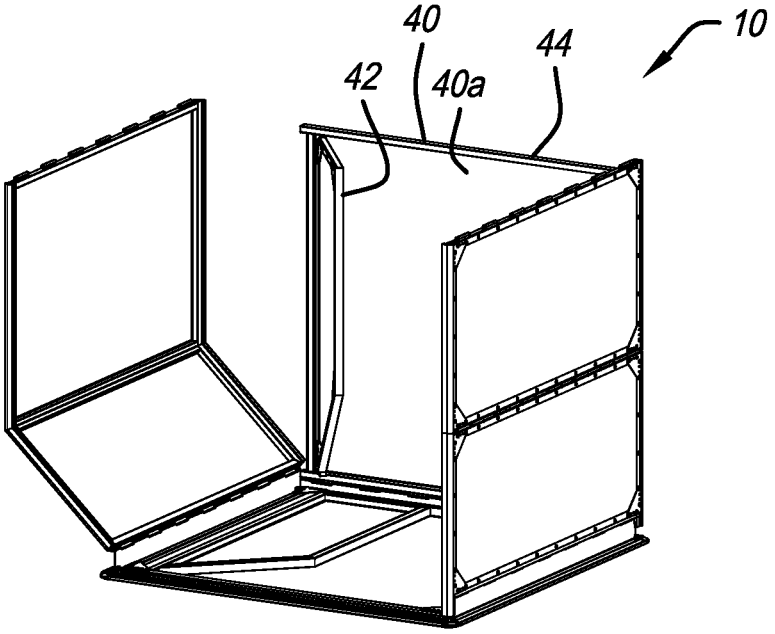
FIG. 7 is a perspective view of the container assembly with the second shear panel partially folded inwardly and the top removed.
Figure 8:
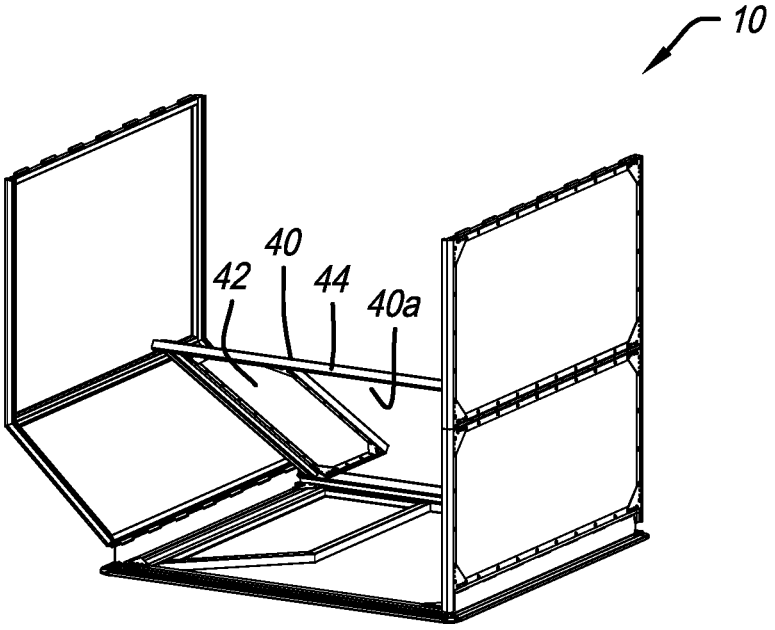
FIG. 8 is a perspective view of the container assembly with the second shear panel folded to the stowed position and the wall panel partially folded downwardly.
Figure 9:
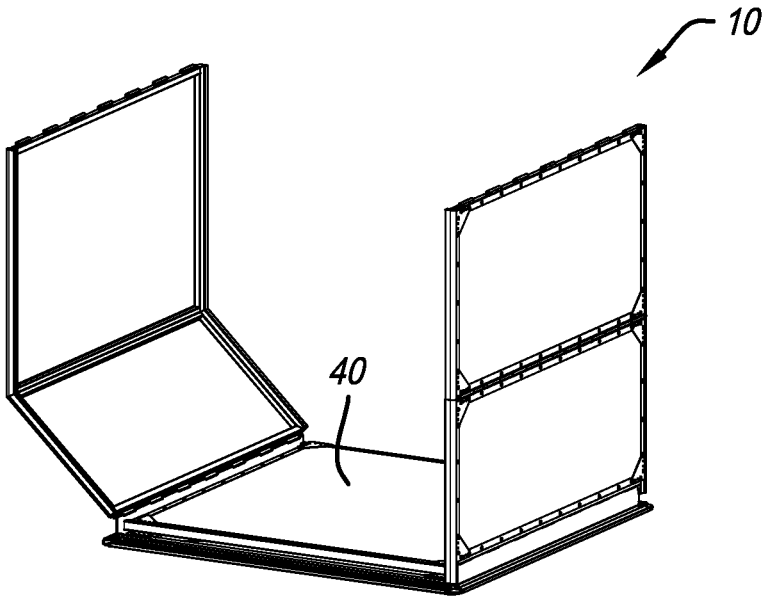
FIG. 9 is a perspective view of the container assembly with the wall panel folded downwardly to the stowed position.
Figure 10:
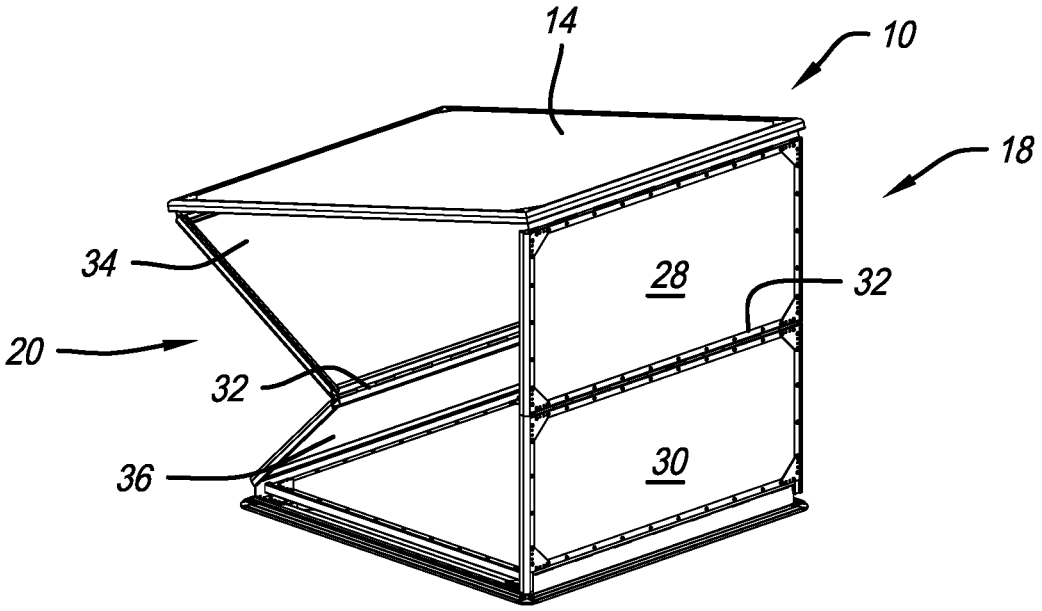
FIG. 10 is a perspective view of the container assembly with the outboard wall partially folded downwardly.
Figure 11:
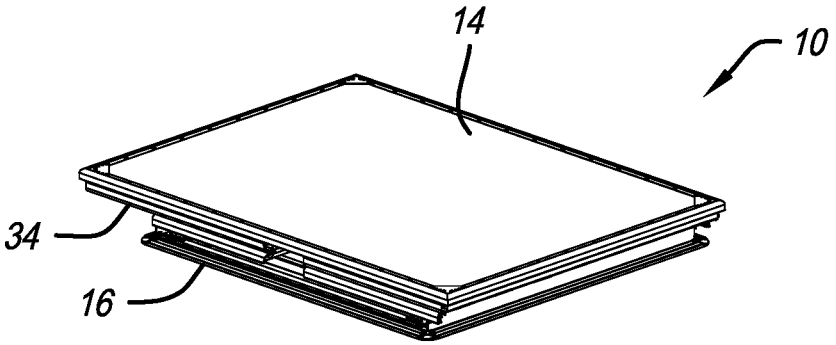
FIG. 11 is a perspective view of the container assembly with both the inboard and outboard walls folded to the stowed position and the entire container assembly in the collapsed position.

Next, as shown in FIGS. 5-6, the door frame 25 (together with the first shear panel 38) is folded downwardly from the use position to the stowed position (FIG. 6). Next, as shown in FIG. 7, the second shear panel 42 is folded inwardly from the use position (FIG. 2) to the stowed position (FIG. 8). In the stowed position, the second shear panel 42 is received in the wall panel 40. Next, as shown in FIGS. 8-9, the wall panel 40 (together with the second shear panel 42) is folded downwardly from the use position to the stowed position (FIG. 9). Next, as shown in FIGS. 10 and 11, the inboard and outboard walls 18 and 20 are folded inwardly (only the outboard wall 20 is show being folded in FIG. 10) and downwardly to the collapsed position. During this step, the top wall 14 moves downwardly and the upper and lower panels 28 and 30 of the inboard wall 18 and the upper and lower panels 32 and 34 outboard walls of the outboard wall 20 hinge or pivot with respect to one another so that the upper panels are stacked on top of the lower panels. In the collapsed position, as shown in FIG. 10 (also see FIG. 24), the top wall is stacked on or positioned above the upper panels, the upper panels are stacked on or positioned above the lower panels, the lower panel of the outboard wall is stacked on or positioned above the second shear panel, the second shear panel is stacked on or positioned above the first shear panel, and the first shear panel is stacked on or positioned above the base.

Figure 12:
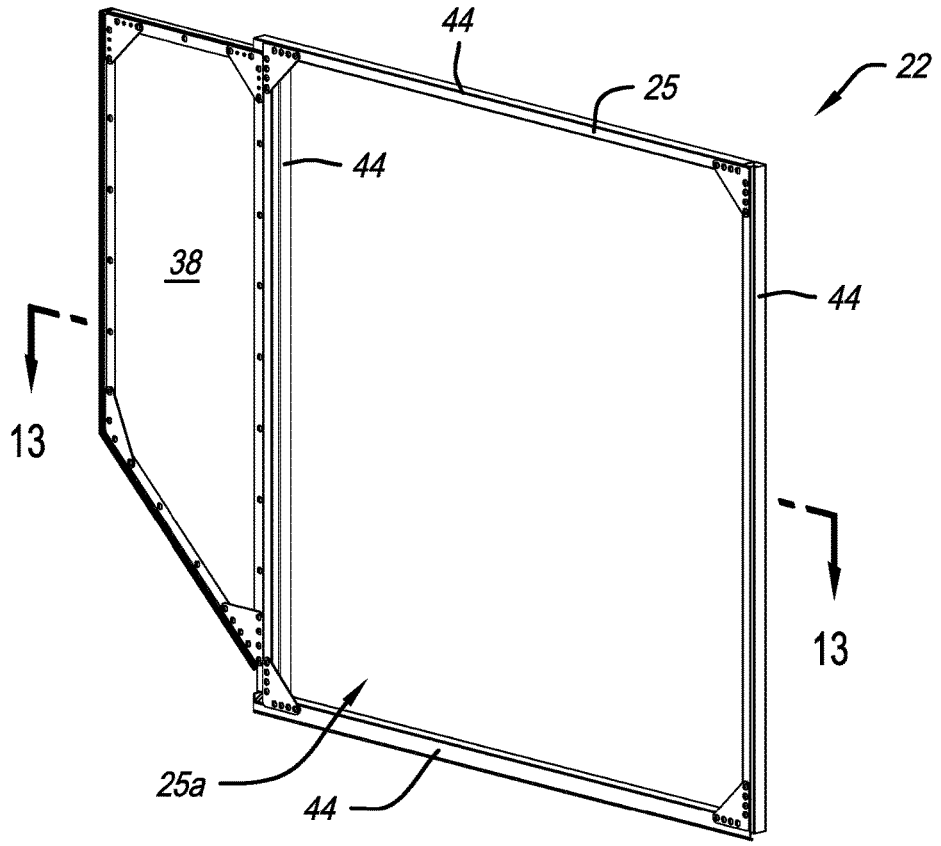
FIG. 12 is a perspective view of the first lateral wall with the first shear wall in the use position.
Figure 13:
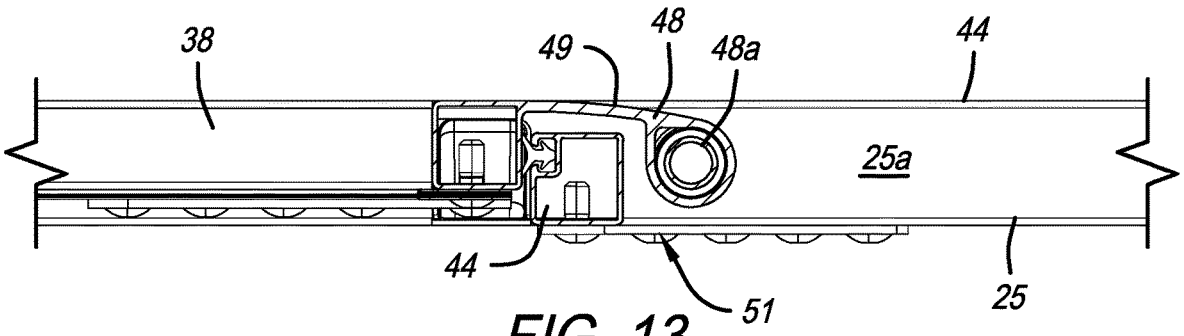
FIG. 13 is a cross-sectional view taken along line 13-13 of FIG. 12.
Figure 14:
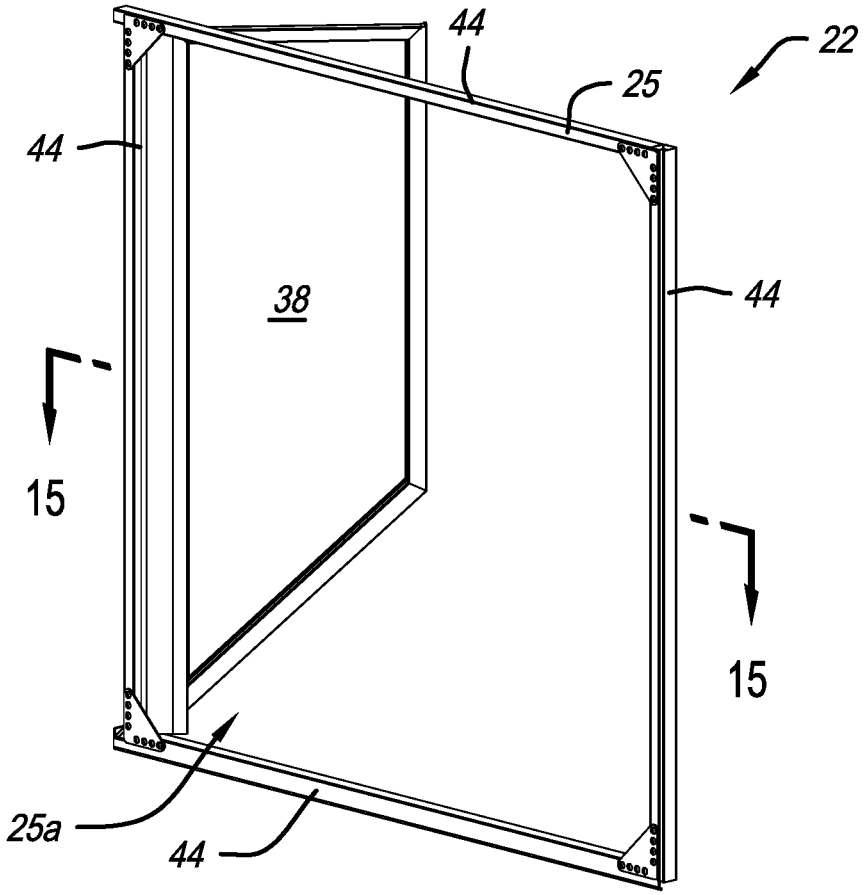
FIG. 14 is a perspective view of the first lateral wall with the first shear wall partially folded inwardly.
Figure 15:
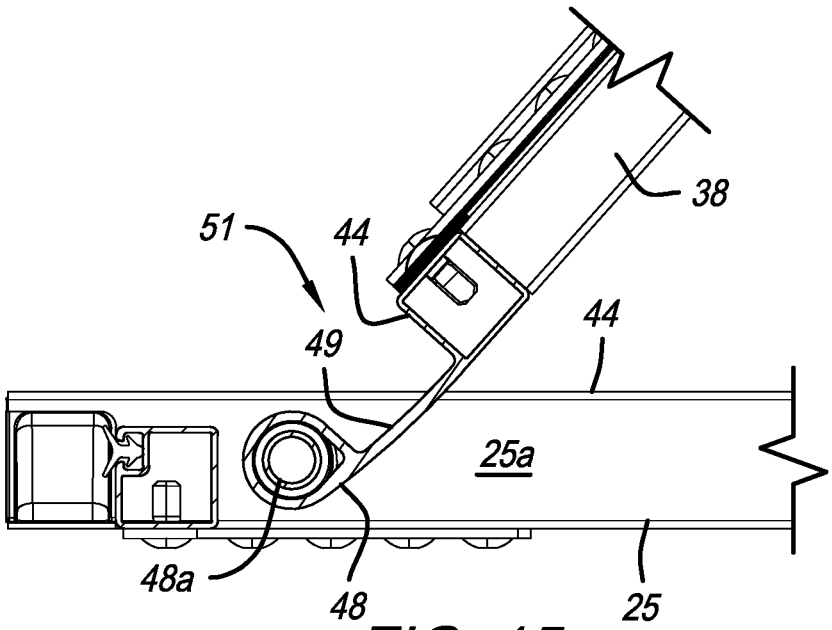
FIG. 15 is a cross-sectional view taken along line 15-15 of FIG. 14.
Figure 17:
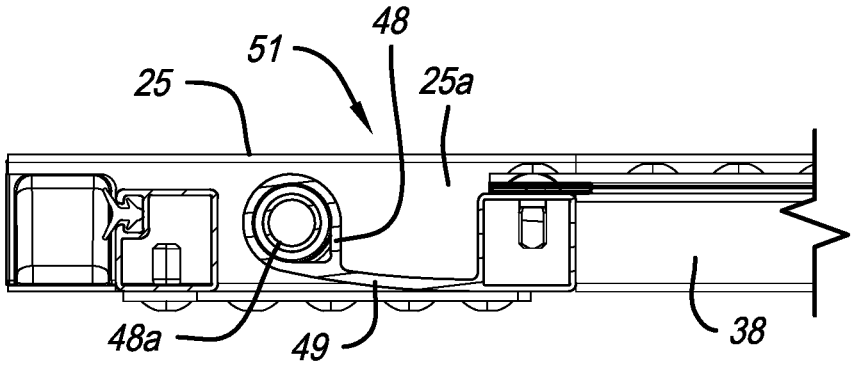
FIG. 17 is a cross-sectional view taken along line 17-17 of FIG. 16.

FIGS. 12-17 demonstrate how the first lateral wall 22 folds such that the first shear panel 38 moves from the use position to the stowed position. FIGS. 12 and 13 show the first shear panel 38 in the use position. FIGS. 14 and 15 show the first shear panel 38 partially hinged or folded between the use and stowed positions. FIGS. 16 and 17 show the first shear panel 38 in the stowed position. The door frame 25 includes a plurality (top, bottom left and right) of frame members 44 that define a door frame interior 25*a*. In a preferred embodiment, to save or reduce height when the container assembly is in the collapsed position and when the first shear panel 38 is in the stowed position, the first shear panel 38 hinges or pivots into the door frame interior 25*a*, as shown in FIGS. 16 and 17. As shown in FIGS. 13, 15 and 17, the first shear panel 38 includes a hinge member 48 that hinges or pivots on a hinge pin 48*a* associated with the door frame (the hinge pin and hinge member can be reversed so that the hinge pin is on the first shear panel and the hinge member is on the door frame. In a preferred embodiment, a connection member 49 extends outwardly from the hinge member 48 and connects to the first shear panel 38 (the frame member 44 thereof). As shown in FIG. 13, the hinge member 48, connection member 49 and frame member 44 of the first shear panel 38 define a clearance recess 51 that receives the adjacent frame member 44 (in FIG. 13, the left frame member 44) of the door frame 25). This allows the first shear member 44 to rotate approximately 180° from the use position to the stowed position (as shown in FIGS. 13 and 17). These figures and explanation also apply to the second shear panel 38 and how it folds into the wall panel interior 40*a* of the wall panel 40 of the second lateral wall 24.

It will be appreciated that the steps discussed above are essentially reversed when unfolding the container assembly 10 or when moving the container assembly 10 from the collapsed position to the use position. As certain of the panels and sides are moved to the user position, the panel may be secured to the adjacent panel. For example, certain of the frame members 44 of the adjacent panels may be complementary components that secure one panel to the adjacent panel. For example, the frame member of a movable panel may secure to the frame member of an adjacent panel via magnets, Velcro, buttons, snaps, zippers, friction fit, snap fit, interference fit or any other attachment member.

Figure 18:
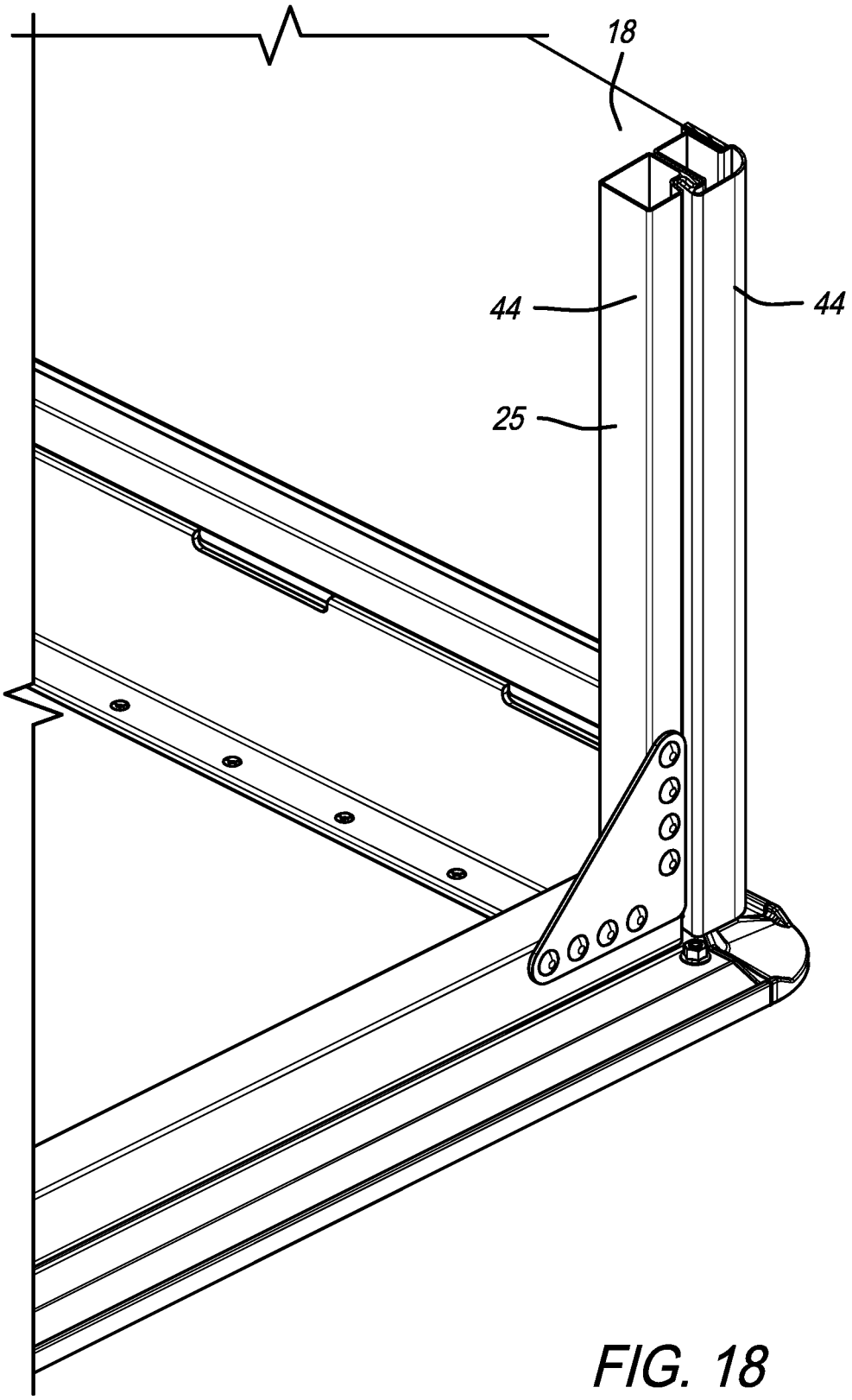
FIG. 18 is a cross-sectional perspective view showing how the door frame is secured to the inboard wall.
Figure 19:
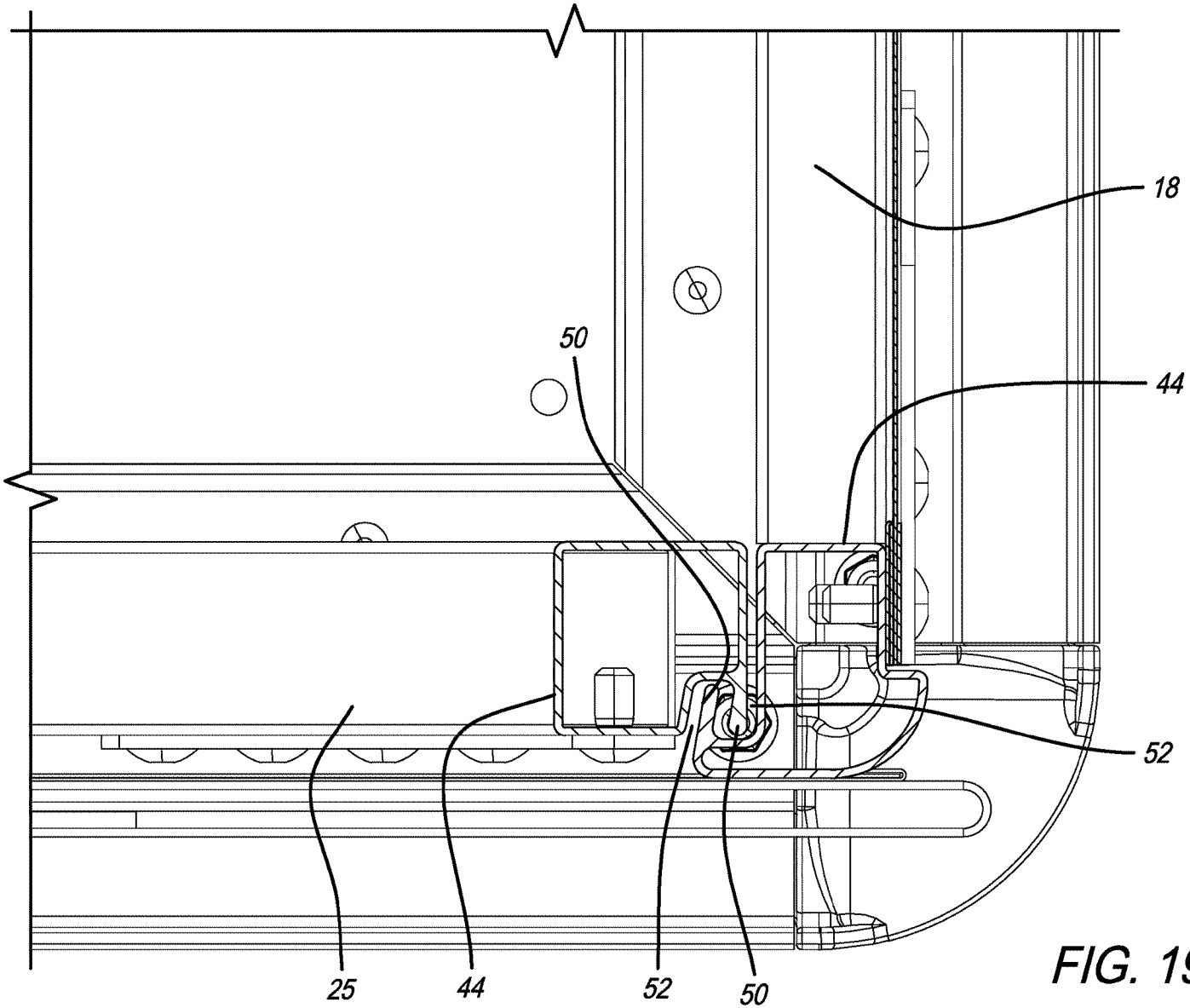
FIG. 19 is a cross-sectional view showing how the door frame is secured to the inboard wall.
Figure 20:
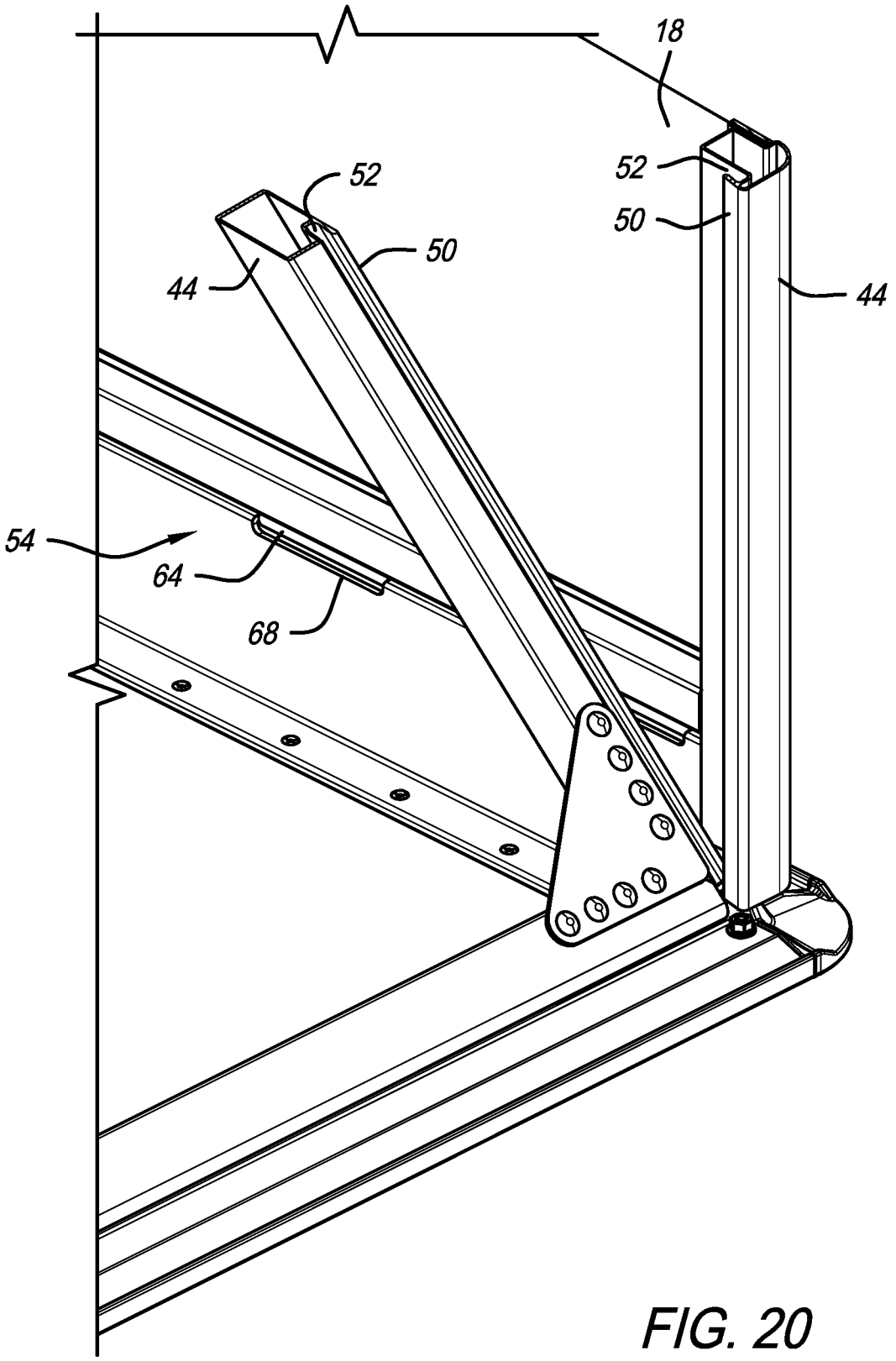
FIG. 20 is a cross-sectional perspective view showing the door frame partially folded downwardly from the inboard wall.
Figure 21:
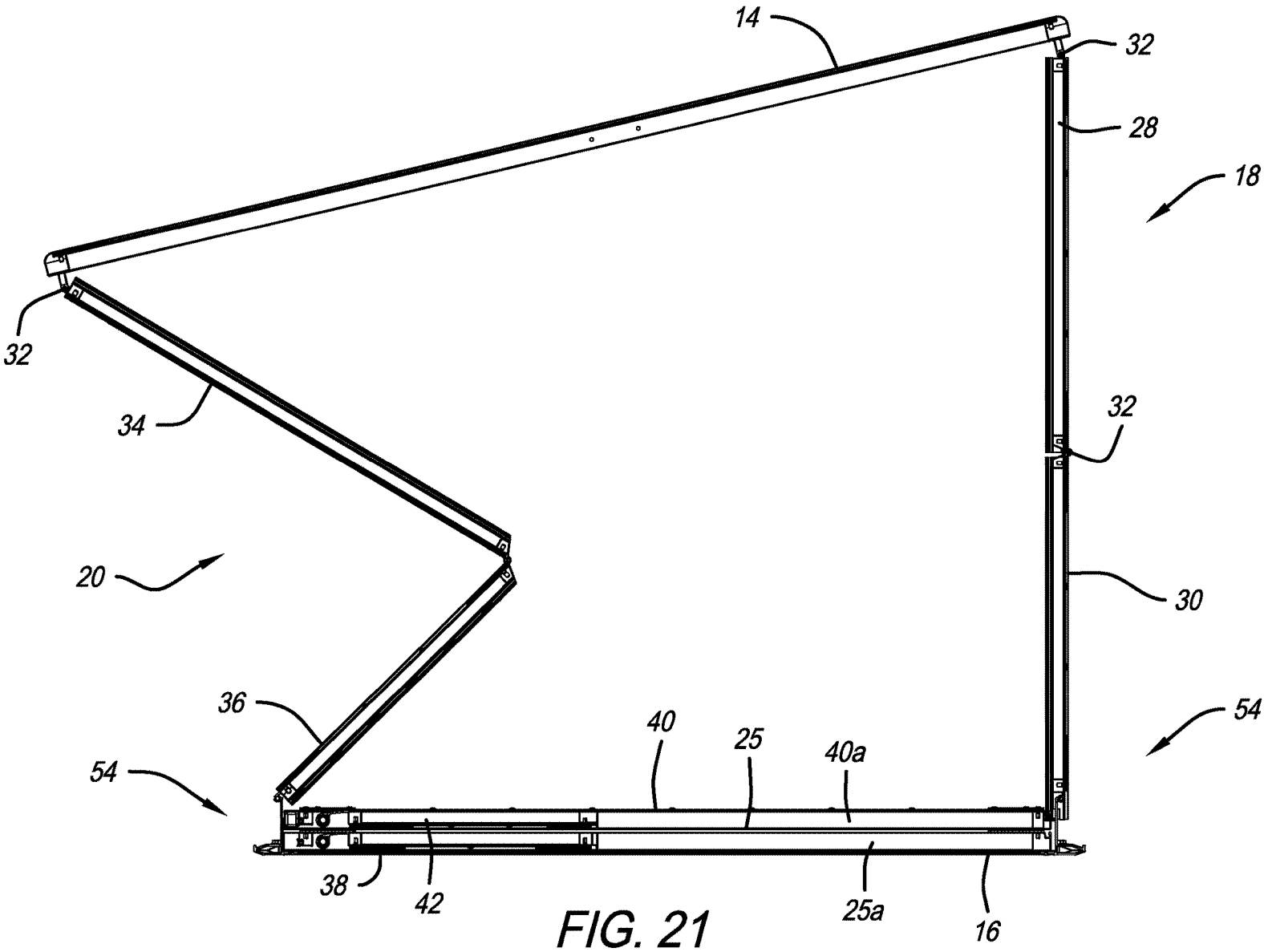
FIG. 21 is a cross-sectional view of the container assembly in the position shown in FIG. 10.
Figure 22:
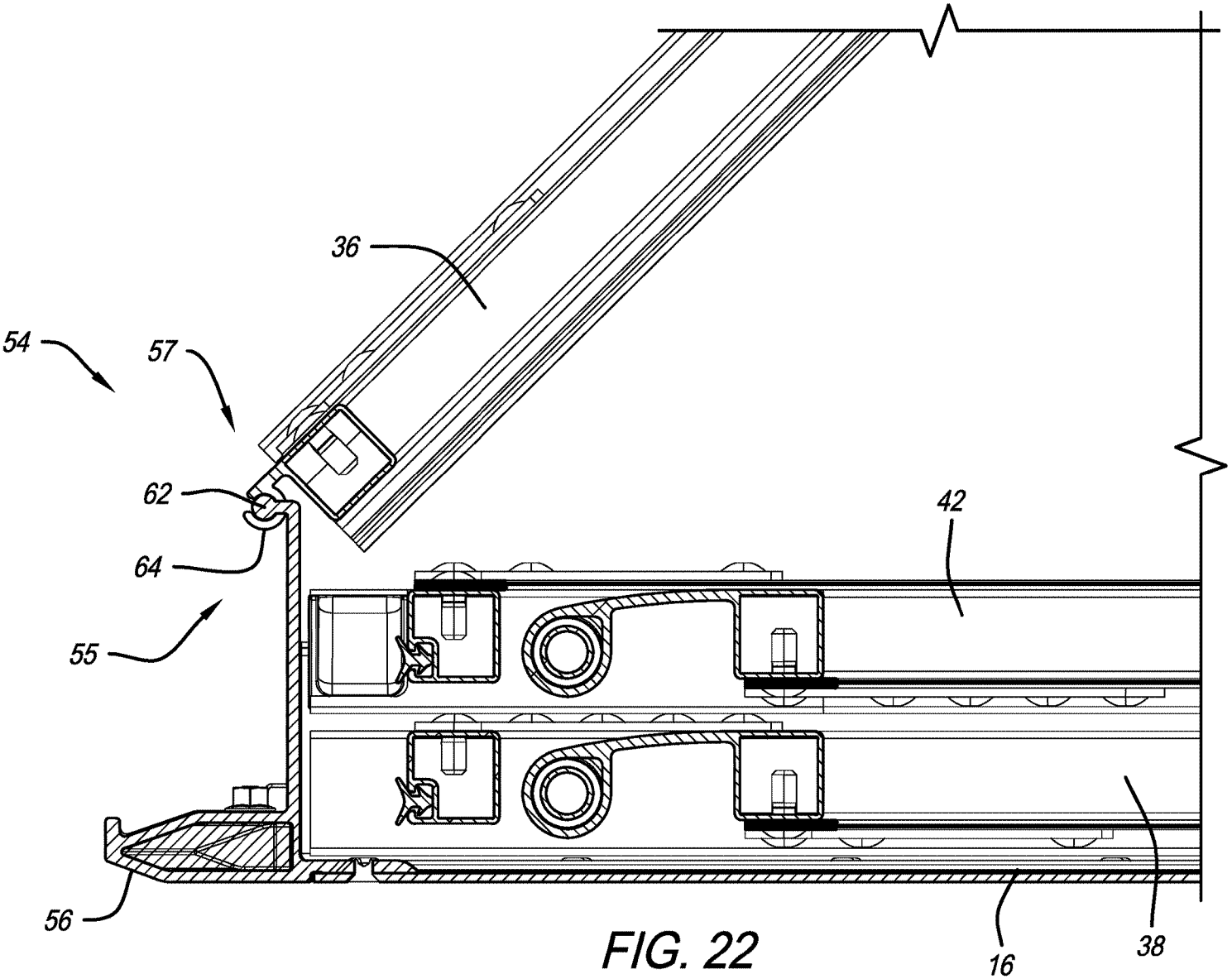
FIG. 22 is a cross-sectional view taken from the lower left corner of FIG. 21 showing the bottom hinge assembly and the lower panel of the outboard wall partially folded.

FIGS. 18-20 show a preferred embodiment of securing a movable or pivotable frame member 44 to an adjacent frame member 44. For this description, the pivotable frame member is numbered frame member 44 or is referred to as a first frame member 44 and the stationary frame member is numbered frame member 44*a* or is referred to as a second frame member 44*a*. It should be understood that the "stationary" frame member is not necessarily stationary as it is foldable and collapsible. However, with respect to the unfolding of the container assembly 10, the "stationary" frame member 44*a* is stationary when the pivotable frame member 44 is pivoted into place such that it interlocks with the stationary frame member 44*a*, as described herein.

In particular, FIGS. 18-19 show one of the frame members 44 of the door frame 25 secured to the upright frame member 44 of the inboard wall 18. Each of the frame members 44 includes a vertically extending tab 50 that is received in a vertically extending recess 52 in the opposite frame member 44. As shown in FIG. 19, tab 50 of each frame member 44 partially defines the recess 52 of that frame member 44. This secures or interlocks the door frame 25 to the outboard wall 18. FIGS. 18-20 show the interlocking frame members 44 of the first lateral side wall and the inboard wall. However, it will appreciated that similar interlocking frame members 44, tabs 50 and recesses 52 are included on the frame members 44 of other walls where two adjacent walls that are pivotable with respect to one another meet.

Figure 19A:
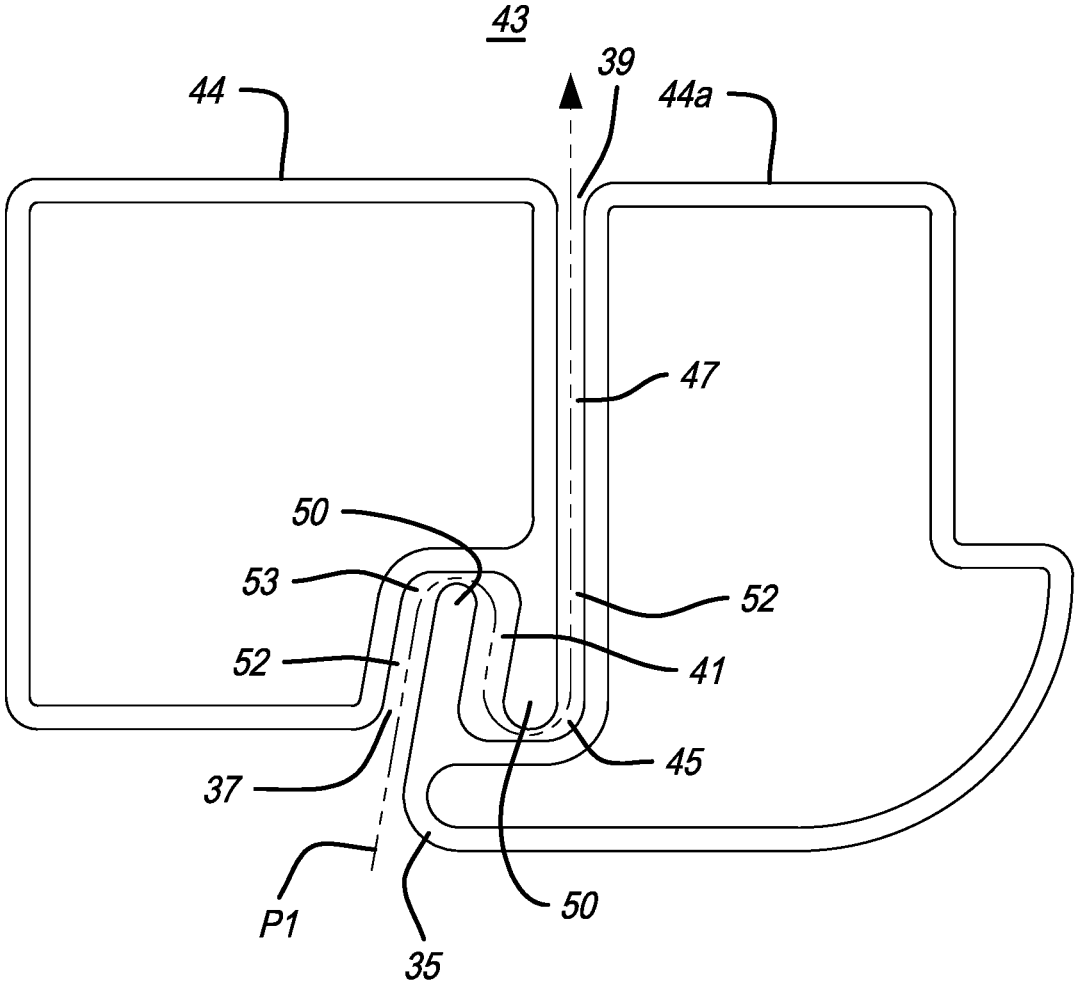
FIG. 19A shows the path between adjacent frame members having a pivotable connection therebetween that water or other liquid must traverse to enter the container interior from the outside.

Another feature of the interlocking frame members 44 is the water resistance capability or the cability to help keep water and other liquids out of the interior of the container or container interior 43. FIG. 19A includes an arrow showing the path that liquid must traverse (the liquid path P1) to enter the container interior 43. Due to the many turns that the liquid path P1 takes and the fact that the adjacent frame members 44 are in a generally vertical orientation when the container assembly 10 is in the use position, it is difficult for water to get from the container exterior, through the liquid path and into the container interior. As shown in FIG. 19A, the liquid path P1 when the opposing tabs 50 on the two frame members 44 are received in the recesses 52, the liquid path P1 includes a path entrance 37, a first U-shaped channel 53, a second U-shaped channel 45 that faces in a direction opposite the first U-shaped channel, an extended portion 47 that extends to a path exit 39 that communicates with the container interior 43. The first and second U-shaped channels include a common arm 41. The liquid path P1 is partially defined by the tabs 50 and recesses 52. Furthermore, as shown in FIG. 19A, the stationary frame member 44*a* includes an extension portion 35 that allows the tab 50 of the stationary frame member 44*a* to reach and be received in the recess 52 of the pivotable frame member 44.

Figure 23:
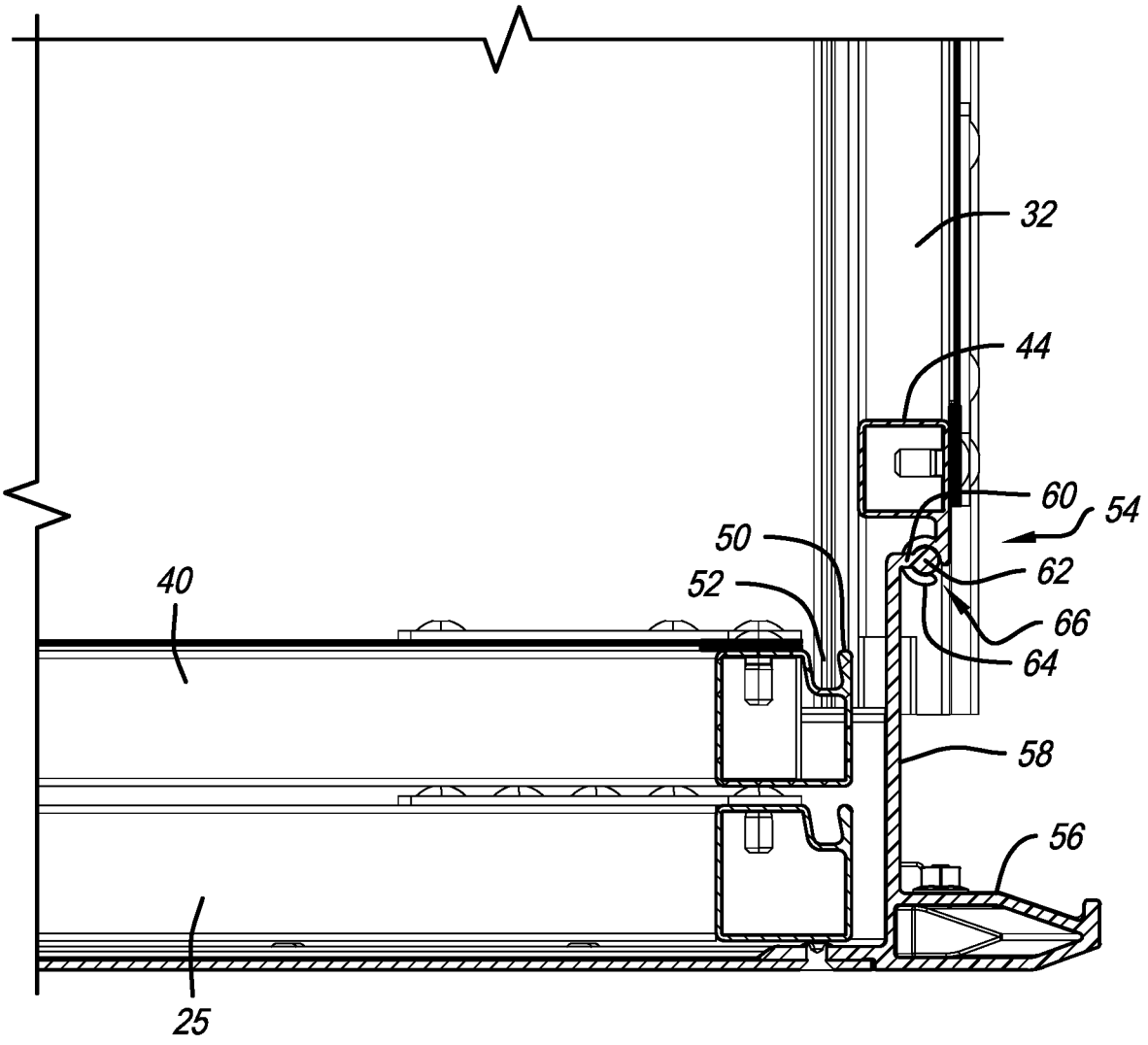
FIG. 23 is a cross-sectional view taken from the lower right corner of FIG. 21 showing the bottom hinge assembly and the lower panel of the inboard wall in the use or erect position.
Figure 24:
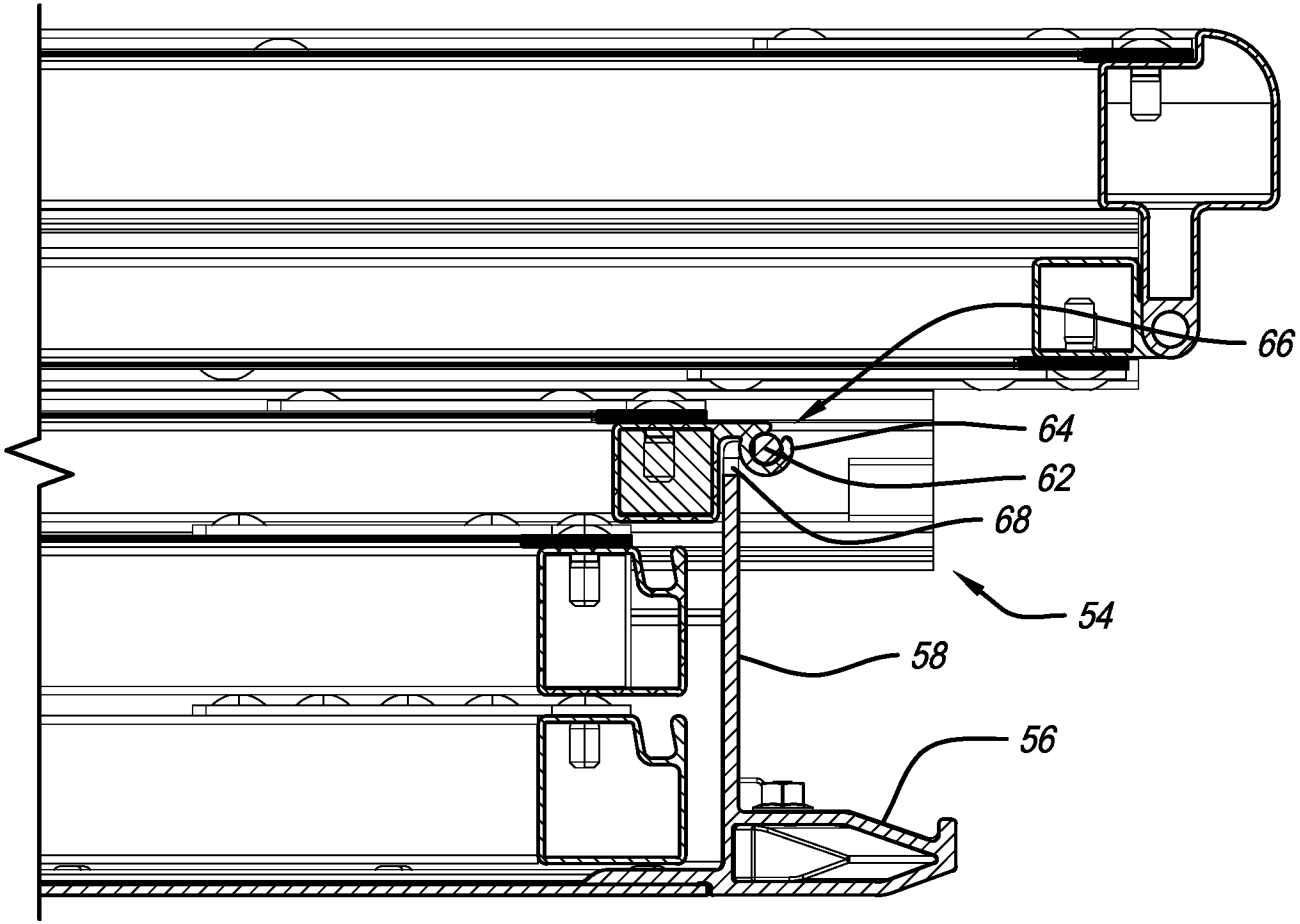
FIG. 24 is a cross-sectional view showing the lower left corner of FIG. 21 with the bottom hinge assembly and the lower panel of the inboard wall in the collapsed or folded position.
Figure 25:
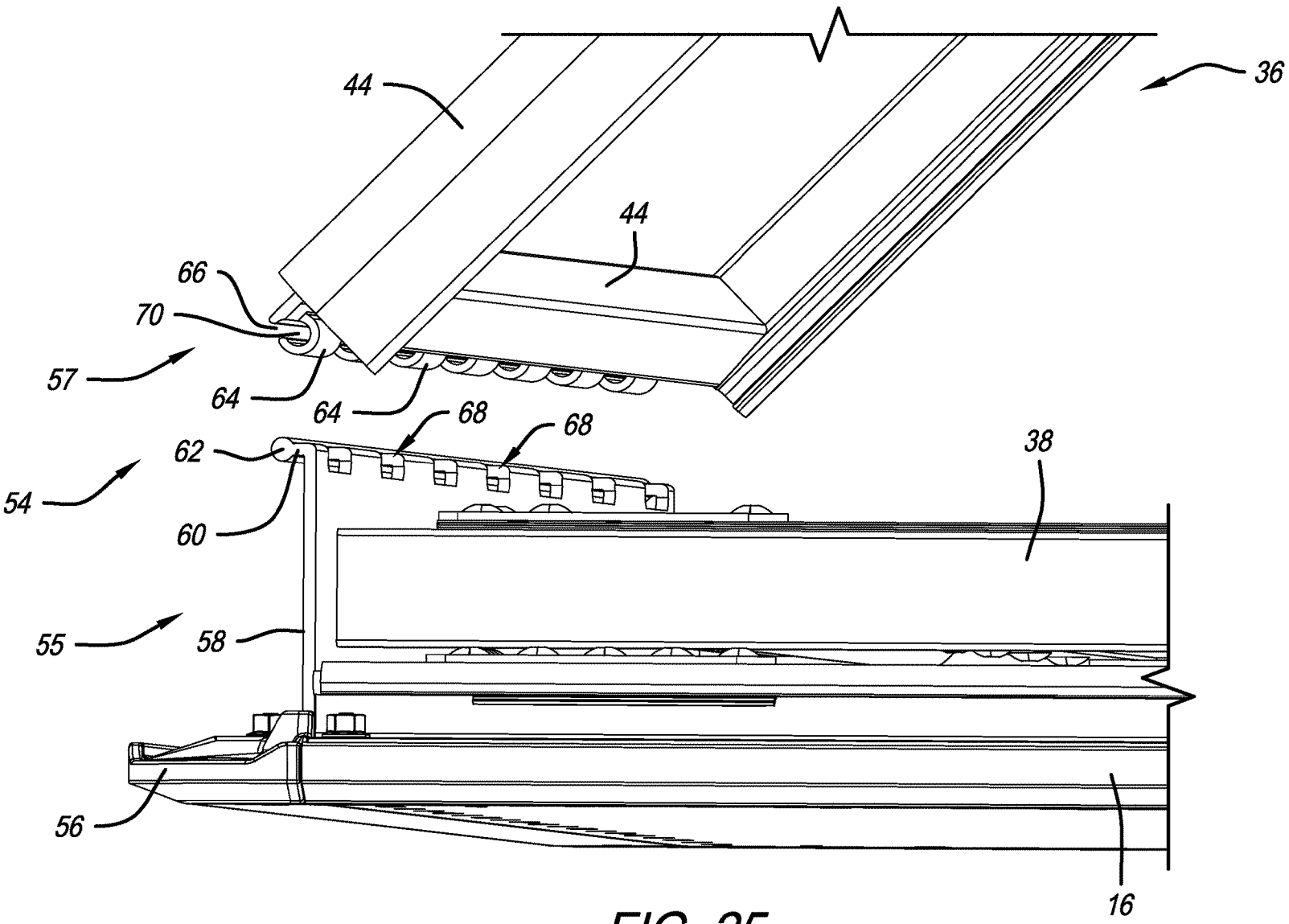
FIG. 25 is a perspective view of the bottom hinge assembly that connects the lower panel of the outboard wall to the bottom 16 and showing the lower panel exploded from the hinge portion.

FIGS. 21-26 show the bottom hinge assemblies 54, how they help allow the stacking of the different panels as everything is moved to the collapsed position and how the bottom hinge assembly 54 interlocks and allows sliding of the complementary parts so the container assembly 10 can be assembled. As shown in FIG. 25, the bottom hinge assembly 54 includes a hinge portion 55 on the base 16 and a knuckle portion 57 on the lower panel 38 or lower panel 30. As shown in FIGS. 23-25, the hinge portion 55 includes a base 56, a first extension member 58, a second extension member 60 and a hinge rod 62. The knuckle portion includes a plurality of knuckle members 64 that are C-shaped and include a channel 66 defined therein. The hinge portion 55 also includes a plurality of knuckle receiving openings 68 defined in the first and second extension members 58 and 60.

Figure 26:
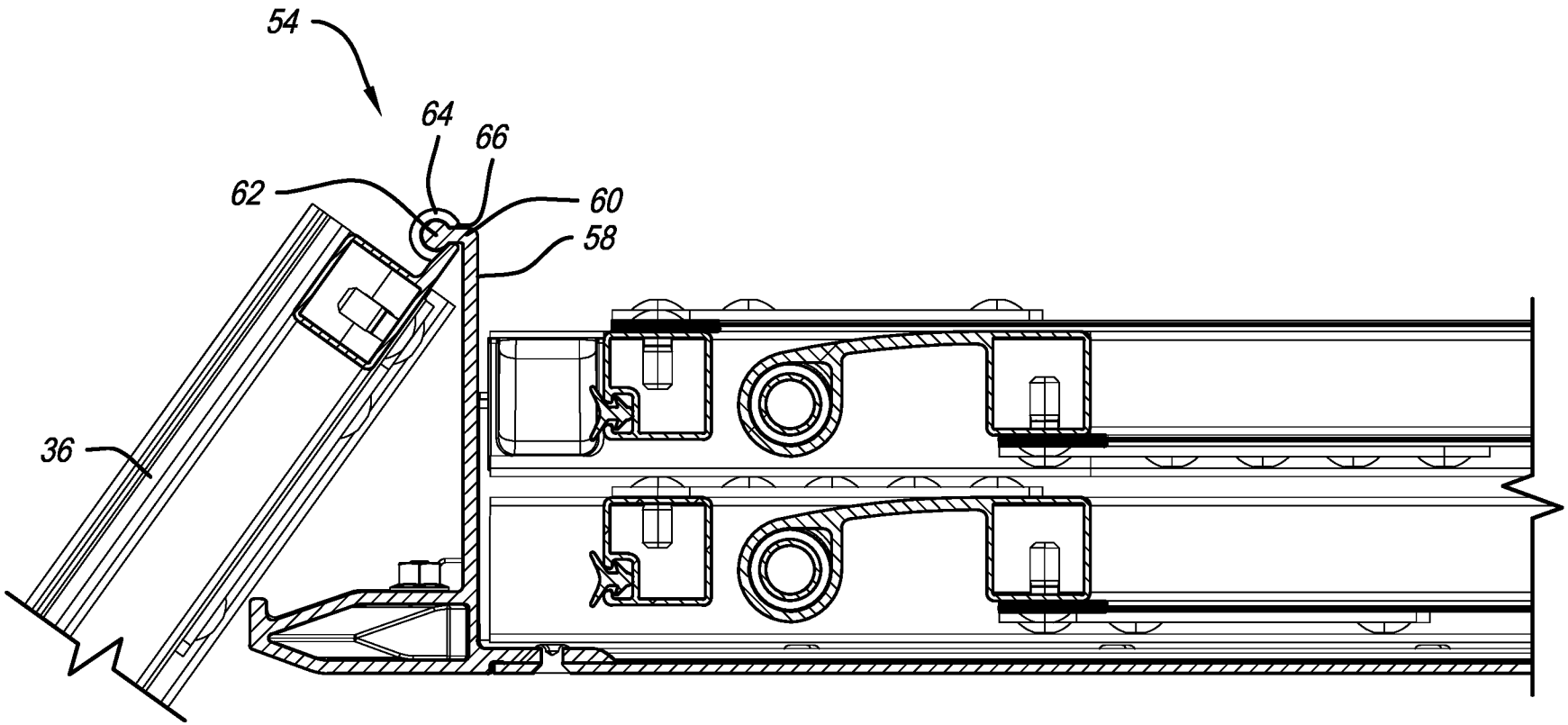
FIG. 26 is a cross-sectional view showing the lower left corner of FIG. 21, but with the lower panel of the outboard wall in the sliding or assembly position.
Figure 27:
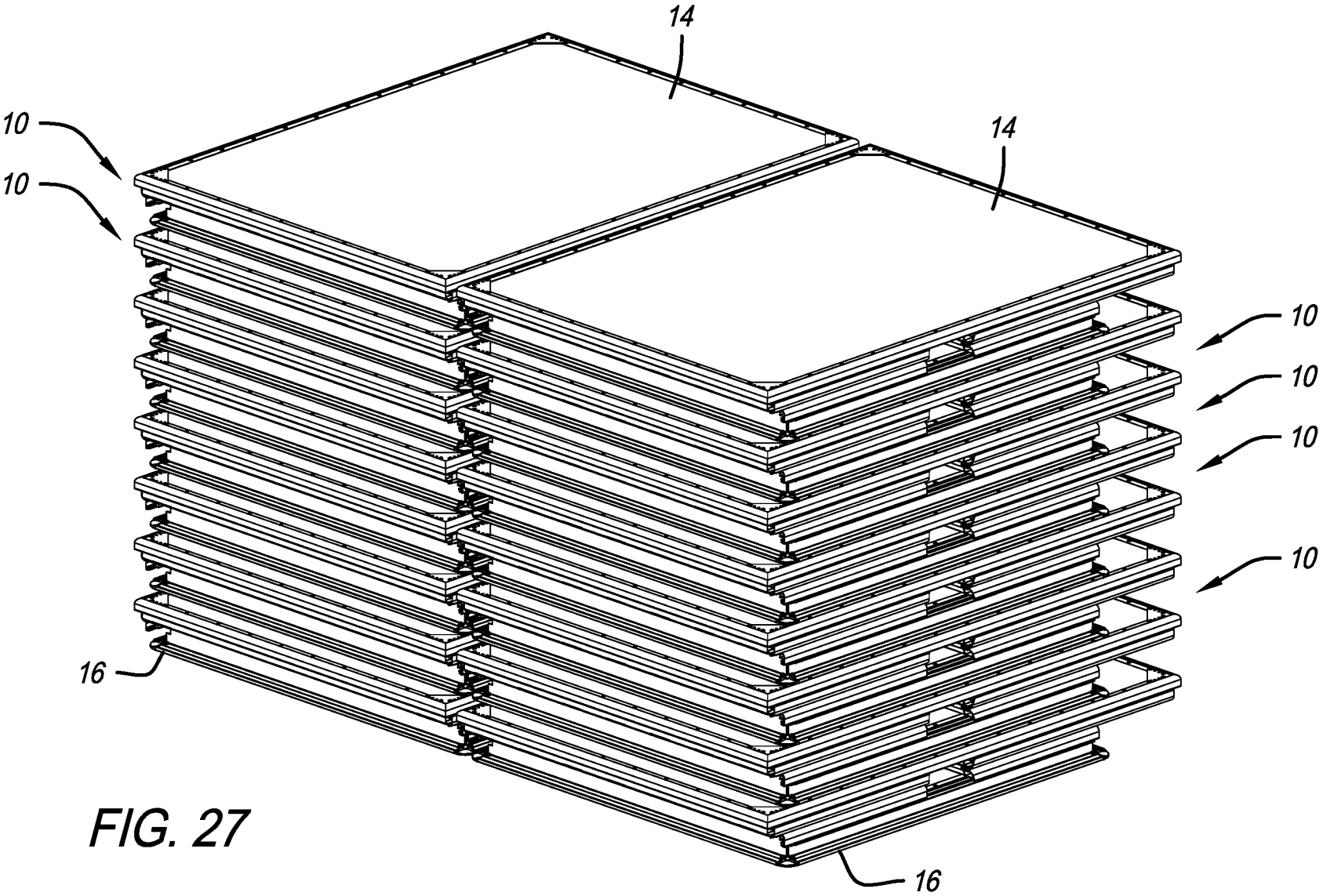
FIG. 27 is a perspective view of a plurality of container assemblies in a stacked position.

As shown in FIG. 26, in a preferred embodiment, the hinge portion 55 and knuckle portion 57 are slidable with respect to one another when positioned in an assembly position so that the two walls or panels can be assembled or secured to one another. In all other positions, (e.g., the use and collapsed positions shown in FIGS. 23 and 24) the hinge portion 55 and knuckle portion 57 (and, therefore, the walls or panels they are a part of) are not slidable with respect to one another. In the assembly position, as shown in FIG. 26, channel 66 is aligned with the second connection portion 60. Thus, allowing the hinge rod 62 to be slideable with respect to the knuckle opening 70 (see FIG. 25) and vice versa. Therefore, for example the knuckles 64 of the inboard wall (and/or outboard wall) can be slid onto the hinge rod 62 in a direction parallel to the axis of the hinge rod when the lower panel 36 is positioned as shown in FIG. 26 (the assembly position). In any other position, a portion of the knuckles 64 is positioned in the knuckle receiving openings, thus preventing and sliding in the axial direction of the hinge rod axis.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. Further, any specific numbers noted herein are only examples: alternative implementations may employ differing values, measurements or ranges.

Although the operations of any method(s) disclosed or described herein either explicitly or implicitly are shown and described in a particular order, the order of the operations of each method may be altered so that certain operations may be performed in an inverse order or so that certain operations may be performed, at least in part, concurrently with other operations. In another embodiment, instructions or sub-operations of distinct operations may be implemented in an intermittent and/or alternating manner.

The teachings of the disclosure provided herein can be applied to other systems, not necessarily the system described above. The elements and acts of the various embodiments described above can be combined to provide further embodiments. Any measurements or dimensions described or used herein are merely exemplary and not a limitation on the present invention. Other measurements or dimensions are within the scope of the invention.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. § 112, ¶6, other aspects may likewise be embodied as a means-plus-function claim, or in other forms, such as being embodied in a computer-readable medium. (Any claims intended to be treated under 35 U.S.C. § 112, ¶6 will include the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A collapsible container assembly comprising:

a first lateral side wall that includes a door frame and a first shear wall, wherein the door frame defines a door frame interior, and wherein the first shear wall is pivotable between a use position where the first shear wall is not positioned in the door frame interior and a stowed position where the first shear wall is positioned in the door frame interior, a second lateral side wall that opposes the first lateral side wall and includes a wall panel and a second shear wall, wherein the wall panel defines a wall panel interior, and wherein the second shear wall is pivotable between a use position where the second shear wall is not positioned in the wall panel interior and a stowed position where the second shear wall is positioned in the wall panel interior, an outboard wall that includes upper and lower panels that are pivotably connected to one another, an inboard wall that opposes the outboard wall and includes upper and lower panels that are pivotably connected to one another, a base, wherein the door frame, wall panel, inboard wall and outboard wall are pivotably connected to the base, and a top, wherein the inboard wall and outboard wall are pivotably connected to the top.

2. The collapsible container assembly of claim 1 wherein the first shear wall is pivotable 180° between the use position and the stowed position, and wherein the second shear wall is pivotable 180° between the use position and the stowed position.

3. The collapsible container assembly of claim 2 wherein the first shear wall is pivotably connected to the door frame at a position in the door frame interior, wherein the pivotable connection between the first shear wall and the door frame includes a hinge member associated with one of the first shear wall and the door frame and a hinge pin associated with the other of the first shear wall and the door frame, wherein a connection member extends outwardly from the hinge member and connects to the first shear wall, wherein the door frame includes top, bottom, left and right frame members, wherein a clearance recess is defined by the hinge member, the connection member and a frame member of the first shear wall, wherein in the use position, the left frame member of the door frame is received in the clearance recess, and wherein in the stowed position, the left frame member of the door frame is not received in the clearance recess.

4. The collapsible container assembly of claim 1 wherein the door frame together with the first shear wall is pivotable between a vertical use position and a horizontal stowed position, and wherein the wall panel together with the second shear wall is pivotable between a vertical use position and a horizontal stowed position.

5. The collapsible container assembly of claim 1 wherein the outboard wall is pivotable between a use position and a stowed position, wherein in the stowed position the upper panel is positioned above the lower panel, wherein the inboard wall is pivotable between a use position and a stowed position, wherein in the stowed position the upper panel is positioned above the lower panel, and wherein when the collapsible container assembly is in the collapsed position, the top is positioned above the upper panels of the inboard and outboard walls.

6. The collapsible container assembly of claim 1 wherein the pivotable connection between the outboard wall and the base comprises a bottom hinge assembly that includes a hinge rod that defines a hinge rod axis, wherein the outboard wall is pivotable between a use position, a stowed position and an assembly position, wherein in the assembly position the outboard wall is slidable in a direction that is parallel with the hinge rod axis.

7. The collapsible container assembly of claim 6 wherein the bottom hinge assembly includes a hinge portion associated with one of the base and the outboard wall and a knuckle portion associated with the other of the base and the outboard wall, wherein the knuckle portion includes a plurality of spaced apart C-shaped knuckle members that each include a channel defined therein, wherein the C-shaped knuckle members define a knuckle opening, wherein the hinge portion includes a first extension member, a second extension member extending outwardly from the first extension member and the hinge rod on a distal end of the first extension member, wherein a plurality of knuckle receiving openings are defined in the first and second extension members, wherein the hinge rod is received in the knuckle openings, and wherein when the outboard wall is in the assembly position the channels defined in the plurality of knuckle members are aligned with the second extension members.

8. The collapsible container assembly of claim 1 wherein the first shear wall includes a proximal frame member and a distal frame member, wherein the distal frame member includes a vertically extending tab and adjacent vertically extending recess, wherein the upper panel of the outboard wall includes a plurality of frame members, wherein at least one of the frame members includes a vertically extending tab and adjacent vertically extending recess, wherein when the first shear wall is in the use position, the vertically extending tab of the first shear wall is received in the vertically extending recess of the upper panel of the outboard wall, and wherein the vertically extending tab of the upper panel of the outboard wall is received in the vertically extending recess of the first shear wall.

9. The collapsible container assembly of claim 1 wherein in the collapsed position a footprint of the collapsible container assembly is defined by a footprint of the top.

10. A collapsible container assembly comprising:

a first lateral side wall that includes a door frame and a first shear wall, wherein the door frame defines a door frame interior, wherein the first shear wall is pivotable between a use position where the first shear wall is not positioned in the door frame interior and a stowed position where the first shear wall is positioned in the door frame interior, and wherein first shear panel is pivotable 180° between the use position and the stowed position, a second lateral side wall that opposes the first lateral side wall and includes a wall panel and a second shear wall, wherein the wall panel defines a wall panel interior, and wherein the second shear wall is pivotable between a use position where the second shear wall is not positioned in the wall panel interior and a stowed position where the second shear wall is positioned in the wall panel interior, and wherein the second shear wall is pivotable 180° between the use position and the stowed position, an outboard wall that includes upper and lower panels that are pivotably connected to one another, an inboard wall that opposes the outboard wall and includes upper and lower panels that are pivotably connected to one another, a base, wherein the door frame, wall panel, inboard wall and outboard wall are pivotably connected to the base, and a top, wherein the inboard wall and outboard wall are pivotably connected to the top, wherein the door frame together with the first shear panel is pivotable between a vertical use position and a horizontal stowed position, wherein the wall panel together with the second shear wall is pivotable between a vertical use position and a horizontal stowed position, wherein the outboard wall is pivotable between a use position and a stowed position, wherein in the stowed position the upper panel is positioned above the lower panel, wherein the inboard wall is pivotable between a use position and a stowed position, wherein in the stowed position the upper panel is positioned above the lower panel, and wherein when the collapsible container assembly is in the collapsed position, the top is positioned above the upper panels of the inboard and outboard walls.

11. The collapsible container assembly of claim 10 wherein the pivotable connection between the outboard wall and the base comprises a bottom hinge assembly that includes a hinge rod that defines a hinge rod axis, wherein the outboard wall is pivotable between a use position, a stowed position and an assembly position, wherein in the assembly position the outboard wall is slidable in a direction that is parallel with the hinge rod axis.

12. The collapsible container assembly of claim 11 wherein the bottom hinge assembly includes a hinge portion associated with one of the base and the outboard wall and a knuckle portion associated with the other of the base and the outboard wall, wherein the knuckle portion includes a plurality of spaced apart C-shaped knuckle members that each include a channel defined therein, wherein the C-shaped knuckle members define a knuckle opening, wherein the hinge portion includes a first extension member, a second extension member extending outwardly from the first extension member and the hinge rod on a distal end of the first extension member, wherein a plurality of knuckle receiving openings are defined in the first and second extension members, wherein the hinge rod is received in the knuckle openings, wherein when the outboard wall is in the assembly position the channels defined in the plurality of knuckle members are aligned with the second extension members.

13. The collapsible container assembly of claim 12 wherein the first shear panel is pivotably connected to the door frame at a position in the door frame interior, wherein the pivotable connection between the first shear panel and the door frame includes a hinge member associated with one of the first shear panel and the door frame and a hinge pin associated with the other of the first shear panel and the door frame, wherein a connection member extends outwardly from the hinge member and connects to the first shear panel, wherein the door frame includes top, bottom, left and right frame members, wherein a clearance recess is defined by the hinge member, the connection member and a frame member of the first shear panel, wherein in the use position, the left frame member of the door frame is received in the clearance recess, and wherein in the stowed position, the left frame member of the door frame is not received in the clearance recess.

14. The collapsible container assembly of claim 13 wherein the first shear panel includes a proximal frame member and a distal frame member, wherein the distal frame member includes a vertically extending tab and adjacent vertically extending recess, wherein the upper panel of the outboard wall includes a plurality of frame members, wherein at least one of the frame members includes a vertically extending tab and adjacent vertically extending recess, wherein when the first shear panel is in the use position, the vertically extending tab of the first shear panel is received in the vertically extending recess of the upper panel of the outboard wall, and wherein the vertically extending tab of the upper panel of the outboard wall is received in the vertically extending recess of the first shear panel.

* * * * *